US007838193B2

(12) United States Patent
Hagi et al.

(10) Patent No.: US 7,838,193 B2
(45) Date of Patent: Nov. 23, 2010

(54) TONER AND IMAGE FORMING METHOD USING THE TONER

(75) Inventors: Masayuki Hagi, Minoo (JP); Takuya Kadota, Kobe (JP); Hiroaki Katoh, Nagaokakyo (JP); Atsushi Yamamoto, Kawanishi (JP); Katsunori Kurose, Takarazuka (JP); Yoshihiro Mikuriya, Nishinomiya (JP); Masahide Inoue, Katsuragi (JP); Hideaki Yasunaga, Ibaraki (JP); Minoru Nakamura, Takarazuka (JP); Yoshimichi Ishikawa, Itami (JP); Hiroyuki Murakami, Toyonaka (JP)

(73) Assignee: Ricoh Company Limited, Tokyo (JP)

( * ) Notice: Subject to any disclaimer, the term of this patent is extended or adjusted under 35 U.S.C. 154(b) by 948 days.

(21) Appl. No.: 11/670,257

(22) Filed: Feb. 1, 2007

(65) Prior Publication Data

US 2007/0190443 A1 Aug. 16, 2007

(30) Foreign Application Priority Data

Feb. 14, 2006 (JP) ..... 2006-036086
Mar. 7, 2006 (JP) ..... 2006-060883
Mar. 17, 2006 (JP) ..... 2006-075640

(51) Int. Cl.
*G03G 9/08* (2006.01)

(52) U.S. Cl. ..... 430/108.6; 430/108.7; 430/123.51

(58) Field of Classification Search ..... 430/108.7, 430/108.6, 123.51
See application file for complete search history.

(56) References Cited

U.S. PATENT DOCUMENTS

| | | | | |
|---|---|---|---|---|
| 5,707,770 | A * | 1/1998 | Tanikawa et al. | 430/108.6 |
| 5,858,597 | A * | 1/1999 | Mizoh et al. | 430/108.6 |
| 5,981,132 | A * | 11/1999 | Kurose et al. | 430/108.11 |
| 2005/0112488 | A1* | 5/2005 | Yamada et al. | 430/108.7 |
| 2006/0204882 | A1 | 9/2006 | Nozaki et al. | |
| 2006/0210902 | A1 | 9/2006 | Nakamura et al. | |
| 2006/0275686 | A1* | 12/2006 | Kadota et al. | 430/108.1 |
| 2007/0059625 | A1* | 3/2007 | Yamamoto et al. | 430/108.6 |
| 2008/0199234 | A1 | 8/2008 | Hagi et al. | |

FOREIGN PATENT DOCUMENTS

| | | | |
|---|---|---|---|
| EP | 575805 | A1 * | 12/1993 |
| JP | 62061073 | A * | 3/1987 |
| JP | 3-294864 | | 12/1991 |
| JP | 4-214568 | | 8/1992 |
| JP | 5-107921 | | 4/1993 |
| JP | 5-165257 | | 7/1993 |
| JP | 8-171230 | | 7/1996 |
| JP | 10-10772 | | 1/1998 |
| JP | 11-95480 | | 4/1999 |
| JP | 11-184239 | | 7/1999 |
| JP | 2000098650 | A * | 4/2000 |
| JP | 2001-100453 | | 4/2001 |
| JP | 2002-31913 | | 1/2002 |
| JP | 2003031913 | A * | 1/2003 |
| JP | 2003-186240 | | 7/2003 |

OTHER PUBLICATIONS

"Forsterite" Mineral Data Publishing, © 2001. Retrieved from <<http://rruff.geo.arizona.edu/doclib/hom/forsterite.pdf>> on Mar. 11, 2010.*
Oguchi, "The Effects of Carrier and External Additives on the Triboelectric Properties of Toners", Journal of the Imaging Society of Japan, vol. 39, pp. 255-262 (2000).*
English language machine translation of JP 2001-100453 (Apr. 2001).*
U.S. Appl. No. 11/962,522, filed Dec. 27, 2007, Fuwa et al.
U.S. Appl. No. 12/051,248, filed Mar. 19, 2008, Hagi et al.
U.S. Appl. No. 11/855,739, filed Sep. 14, 2007, Fuwa et al.
U.S. Appl. No. 11/851,048, filed Sep. 6, 2007, Murakami et al.
U.S. Appl. No. 11/851,617, filed Sep. 7, 2007, Murakami et al.
U.S. Appl. No. 11/854,783, filed Sep. 13, 2007, Nakamura et al.
U.S. Appl. No. 11/855,759, filed Sep. 14, 2007, Katoh et al.
U.S. Appl. No. 11/856,248, filed Sep. 17, 20007, Murakami et al.
U.S. Appl. No. 12/010,369, filed Jan. 24, 2008, Yasunaga et al.
U.S. Appl. No. 11/684,131, filed Mar. 9, 2007, Yasunaga, et al.
U.S. Appl. No. 11/670,257, filed Feb. 1, 2007, Hagi et al.
U.S. Appl. No. 12/048,865, filed Mar. 14, 2008, Yasunaga et al.
U.S. Appl. No. 12/027,704, filed Feb. 7, 2008, Fuwa et al.
U.S. Appl. No. 11/924,994, filed Oct. 26, 2007, Katoh et al.
U.S. Appl. No. 11/857,175, filed Sep. 18, 2007, Matsumoto et al.
U.S. Appl. No. 11/963,279, filed Dec. 21, 2007, Mikuriya et al.

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

A toner including toner particles including a binder resin, a colorant and a release agent, and an external additive including a first particulate inorganic material having a formula of $Mg_xSi_yO_{x+2y}$ where each of x and y is an integer, and a number average secondary particle diameter of from 0.02 μm to 2 μm, wherein the first atomic ratio (Mg/Si)s in a surface portion of the first particulate inorganic material is not greater than (preferably less than) the second atomic ratio (Mg/Si)e in the entire first particulate inorganic material. Alternatively, a toner including toner particles including a binder resin and a colorant, and an external additive which includes a particulate inorganic material having a formula of $Mg_xSi_yO_{x+2y}$ where each of x and y is an integer and which has a surface treated with a fatty acid.

20 Claims, 2 Drawing Sheets

TONER AND IMAGE FORMING METHOD USING THE TONER

BACKGROUND OF THE INVENTION

1. Field of the Invention

The present invention relates to a toner for developing an electrostatic latent image. In addition, the present invention also relates to an image forming method, an image forming apparatus and a process cartridge, which form visual images using a toner.

2. Discussion of the Background

Recently, there are increasing needs for personal image forming apparatuses (such as copiers and laser printers) which are low-cost and small in size and which are environmentally friendly. In attempting to fulfill the needs, image forming apparatuses using a contact charging device which does not use a corona discharger have been investigated. Specifically, a charger (such as conductive rollers and brushes) is contacted with a surface of an image bearing member (such as photoreceptors) and applies a voltage thereto to charge the surface of the image bearing member so that the image bearing member has a predetermined potential. By using such a contact charger, a relatively simple and small-size charging unit, which can charge image bearing members by applying a relatively low voltage while producing a relatively small amount of ozone compared with cases where a charger using a corona discharger is used, can be used for the image forming apparatuses.

Contact chargers typically apply a DC voltage or a DC voltage overlapped with an AC voltage. In this case, residual toner particles which remain on the surface of the surface of an image bearing member and which have small particle size or light weight repeatedly perform abnormal charging and jumping movements in the vicinity of the contact point between a contact charger and the image bearing member. Therefore, problems such that the residual toner particles are electrostatically adhered to and embedded into the charger and image bearing member tend to be caused. Namely, contact chargers have a drawback in that the charging properties thereof easily deteriorate with time.

On the other hand, oil-less fixing devices have been typically used for color image forming apparatuses (such as color copiers and color laser printers). By using an oil-less fixing device, the fixing unit can be simplified and the running costs can be reduced because oil is not used. Toner for use in image forming apparatuses using an oil-less fixing unit has to have a good releasability and to produce color images with high glossiness. In general, it is impossible to impart a good combination of releasability and glossiness to toner, namely, the properties establish a trade-off relationship.

In attempting to solve the trade-off problem, various toners have been investigated. For example, in pulverization toners, new materials have been investigated for toner constitutional materials such as binder resins and waxes, and in addition wax dispersion methods for forming proper wax domains in toner particles have been also investigated. In contrast, toners prepared by a wet granulation method (such as polymerization methods and solution suspension methods) can include a relatively large amount of wax therein compared with pulverization toners. In addition, some of wet granulation methods can make it possible that a wax is included in a predetermined position of toner particles. Therefore, recently the manufacturing methods and the constitutional materials of polymerization toners and granulation toners have been actively investigated to develop toners suitable for image forming apparatuses having an oil-less fixing device.

In general, toners including a large amount of wax therein tend to cause a problem in that the wax exudes from the surface of toner particles, and the free wax released from the toner particles deteriorates the image qualities. Particularly, when the free wax is adhered to a developer bearing member or an image bearing member and forms a wax film thereon, various problems occur. Specifically, a background development problem in that the background area of images is soiled with toner particles is caused. In addition, when the wax film formed on an image bearing member is transferred to a charger, the charging ability of the charger deteriorates, and thereby a problem in that the image bearing member is defectively charged, resulting in deterioration of image qualities, is caused.

Further, since a granulation toner is manufactured (i.e., granulated) in an aqueous medium while using a surfactant, the resultant toner particles tend to have a relatively poor charge property compared with pulverization toners, and thereby problems such as the background development problem are easily caused.

In addition, when toner particles are prepared by a pulverization method, it is impossible to well disperse a relatively large amount of wax in the toner particles and therefore the particle diameter distribution of the wax particles (domains) in the toner particles is broad. Further, free wax particles are also included in the toner particles. Therefore, the toner has an undesired composition. As a result, the toner has a broad charge quantity distribution and thereby image quality problems due to defectively charged toner particles (such as the background development problem) are caused.

Further, when a wax is unevenly dispersed in toner particles, the toner particles tend to agglomerate. As a result, the toner has poor transferability, resulting in formation of hollow images (such as hollow character or line images).

In attempting to avoid such a filming problem, the following techniques have been investigated:

(1) suitable toner compositions are designed to prevent formation of free waxes and additives, which cause the filming problem;

(2) an abrasion agent which can remove a film is externally added to the surface of toner particles; and (3) a lubricating material is externally added to toner particles so that a film forming material (such as waxes) is hardly adhered to image forming members such as chargers and photoreceptors.

With respect to the technique (2), techniques in that a particulate hard inorganic material having a particle diameter of hundreds of nanometers is added to toner particles as an abrasion agent have been proposed. For example, Japanese patent No. 2,656,230 (i.e., published unexamined Japanese patent application No. (hereinafter JP-A) 08-171230) discloses a technique of using cerium oxide as an abrasion agent. Japanese patent No. 3,407,545 (i.e., JP-A 10-10772) discloses a technique of using strontium titanate having an average particle diameter of from 200 to 800 nm as an abrasion agent. Although these abrasion agents can remove a film formed on a photoreceptor having a cleaning blade, a film formed on image forming members having no cleaning blade (such as contact charging rollers) is hardly removed and rather the abrasion agent is transported to the charging rollers, resulting in deterioration of the charging ability of the charging rollers. In other words, these abrasion agents contaminate charging members.

With respect to the technique (3), metal soaps are typically added as film preventing agents. Although metal soaps can prevent formation of a film on a photoreceptor, the charging properties of the toner deteriorate (for example, a charge-up phenomenon occurs in that the charge quantity of the toner excessively increases, resulting in increase of electrostatic adhesiveness of the toner to carrier particles, and thereby the image density is decreased).

JP-A 2002-31913 discloses a technique of using magnesium silicates (such as attapulgite, and sepiolite) as film preventing agents. These materials can prevent formation of a film on a photoreceptor in a cleaning process. However, since the materials have a high water content and thereby the toner is insufficiently charged, the background development problem, a toner leaking problem and a toner scattering problem, all of which are caused by the insufficiently charged toner, tend to occur.

JP-As 03-294864, 04-214568 and 05-165257 have disclosed techniques of using magnesium silicate treated with a silicone oil as film preventing agents. By using these materials, the fluidity of the resultant toners deteriorates, and in addition charge quantity thereof excessively increases. As a result, problems in that the toner is not well transported in a developing device and image density decreases occur.

JP-A 11-95480 discloses a toner using magnesium silicate as a film preventing agent, wherein the surface of the toner is covered with magnesium silicate at a covering rate of from 60 to 100%. When this toner is used as a negative toner, reversely charged toner particles are easily formed, resulting in occurrence of the background development problem. This is because magnesium silicate has a positive-charging property due to MgO (magnesia) as described in Journal of Japan Imaging Society Vol. 39, No. 3, p. 259.

JP-A 11-184239 discloses a toner including a titanate as a film preventing agent. Although titanate has good film preventing effect, charges of the toner easily leak because titanate has a low resistivity and thereby the background development problem, toner leaking problem and toner scattering problem tend to be caused. In addition, when titanate is transferred to a charging member, the charge imparting ability of the charging member deteriorates.

JP-A 2003-186240 discloses a toner including titania. Since titania has low resistivity and high dielectric constant, addition of a large amount of titania leak the charges of the toner, resulting in decrease of the charge quantity of the toner. In contrast, addition of a small amount of titania increases the charge quantity of the toner. In both cases, the background development problem, toner leaking problem and toner scattering problem are easily caused.

JP-A 2001-100453 discloses a toner including toner particles and an inorganic material which serves as an external additive and which includes at least an alkali metal salt of a fatty acid and a non-alkali metal salt of a fatty acid. However, this toner is insufficient with respect to the properties of background development and toner leakage.

Because of these reasons, a need exists for a color toner which has good charge properties without causing the filming problem and contaminating image forming members such as chargers.

SUMMARY OF THE INVENTION

As an aspect of the present invention, a toner is provided which includes toner particles including at least a binder resin, a colorant and a release agent, and an external additive including a first particulate inorganic material having a formula of $Mg_xSi_yO_{x+2y}$ where each of x and y is an integer, and a number average secondary particle diameter of from 0.02 μm to 2 μm, wherein the first atomic ratio (Mg/Si) sin a surface portion of the first particulate inorganic material is not greater than (preferably less than) the second atomic ratio (Mg/Si)e in the entire first particulate inorganic material. Alternatively, the toner is a toner including toner particles including at least a binder resin and a colorant, and an external additive which includes a particulate inorganic material having a formula of $Mg_xSi_yO_{x+2y}$ where each of x and y is an integer and which has a surface treated with a fatty acid.

As another aspect of the present invention, an image forming apparatus is provided which includes at least an image bearing member configured to bear an electrostatic latent image thereon; a latent image forming device configured to form the electrostatic latent image on the image bearing member and including a charger; and a developing device configured to develop the electrostatic latent image with a developer including the toner mentioned above to form a toner image on the image bearing member.

As yet another aspect of the present invention, a process cartridge is provided which can be detachably set in an image bearing member and which includes at least an image bearing member configured to bear an electrostatic latent image thereon, and a developing device configured to develop the electrostatic latent image with a developer including the toner mentioned above to form a toner image on the image bearing member.

As a further aspect of the present invention, an image forming method is provided which includes:

forming an electrostatic latent image on an image bearing member; and developing the electrostatic latent image with a developer including the toner mentioned above to prepare a toner image on the image bearing member.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
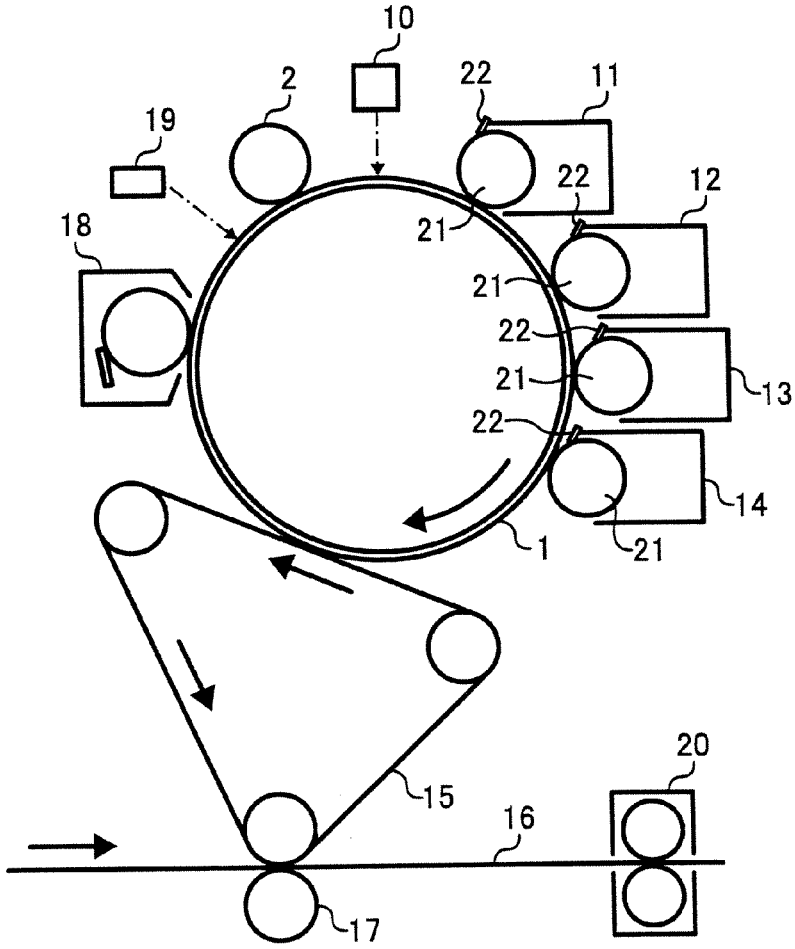
FIG. 1 is a schematic view illustrating an example of the image forming apparatus of the present invention.

An example embodiment of the toner of the present invention includes toner particles including at least a binder resin, a colorant and a release agent, and an external additive including at least one particulate inorganic material. The external additive means an additive which is added to the toner particles so as to be located on a surface of the toner particles.

The particulate inorganic material (hereinafter referred to as an inorganic material A) serving as an external additive has a number average secondary particle diameter of from 0.02 to 2 μm and a formula $Mg_xSi_yO_{x+2y}$ (each of x and y is an integer). The average secondary particle diameter means an average particle diameter of secondary particles, which are aggregates of primary particles. When x is 1 and y is 1, the inorganic material is a material having a specific crystal structure (such as steatite and enstatite). When x is 2 and y is 1, the inorganic material is a material having a specific crystal structure (such as forsterite). The crystal structure can be specified by subjecting the inorganic material to an X-ray diffraction analysis.

In general, $MgO.SiO_2$ complex oxides such as forsterite, steatite and enstatite have properties similar to those of alumina. For example, the complex oxides have a high thermal expansion coefficient. In addition, the complex oxides have a dielectric property at a high frequency region and a high resistivity at a high temperature region. Therefore, the complex oxides have been used as ceramics for electronic parts.

However, conventional $MgO.SiO_2$ complex oxides have a number average primary particle diameter of not less than 0.2 μm, and a number average secondary particle diameter of from 2 to 3 μm. When such a large $MgO.SiO_2$ complex oxide is used as an external additive of toner, the complex oxide is not well adhered to the surface of the toner particles, and thereby problems in that the toner has poor charging properties and the complex oxide damages the photoreceptor for which the toner is used are caused. Therefore, the complex oxides have not been used for toner.

The inorganic material A does not cause the above-mentioned problems. Specifically, the inorganic material A has a number average primary particle diameter of from 0.02 to 0.15 μm, which is much smaller than that of conventional $MgO.SiO_2$complex oxides. It is preferable that the inorganic material A has a structure such that primary particles are agglomerated while being sintered to form sintered aciniform aggregates (secondary particles) having a number average secondary particle diameter of from 0.05 to 2.0 μm, and preferably from 0.1 to 1.5 μm. By using such an inorganic material A, occurrence of the above-mentioned problems can be prevented.

The inorganic material A can be typically prepared by the following method including:

(1) mixing a $Mg(OH)_2$ powder or a MgO powder with a $SiO_2$ powder having a number average primary particle diameter of not greater than 0.10 μm; and (2) sintering the mixture.

The sintered mixture preferably has a structure of forsterite, steatite or enstatite, which can be determined by an X-ray diffraction analysis. In addition, it is preferable that the sintered mixture does not include an unreacted raw material (i.e., MgO, $Mg(OH)_2$ and $SiO_2$).

The inorganic material A is preferably subjected to a surface treatment so that the atomic ratio Mg/Si of Mg to Si on the surface portion of the complex oxide is decreased. By performing such a surface treatment on the complex oxide, the charge property (polarity) of the external additive (and the toner) can be changed toward the negative side. Therefore, when a negative-charging contact charger is used as a charger, occurrence of a problem in that toner particles remaining on the photoreceptor are transferred to the charger can be prevented. Therefore, deterioration of the charger with time can be delayed, and thereby the life of the charger can be prolonged.

Specifically, the surface treatment is typically performed as follows. When the inorganic material A is prepared by a wet method, an acidic aqueous medium (having a pH less than 7) is used for a pulverization/dissociation process and/or a washing process of the wet method. By performing such an acidic treatment, a part of crystal structure of the MgO $SiO_2$ complex oxide is destroyed. It is considered that, in this case, since Mg is has a higher solubility to acids than Si, Mg is rapidly dissolved in the acidic aqueous medium, and therefore the atomic ratio Mg/Si decreases.

The ratio (Mg/Si)s/(Mg/Si)e of the atomic ratio (Mg/Si)s in the surface portion of the toner to the atomic ratio (Mg/Si)e in the entire toner is preferably from 0.6 to 0.9. When the ratio (Mg/Si)s/(Mg/Si)e is too large, the charge property of the inorganic material A (and the toner) cannot be sufficiently changed toward the negative side. In contrast, when the ratio is too small, the crystal structure of the inorganic material A is seriously damaged and thereby the electric properties of the inorganic material A are deteriorated. The ratio (Mg/Si)e in an inorganic material A can be determined by a quantitative method (such as fluorescent X-ray analysis) which can analyze the composition of the entire inorganic material. The ratio (Mg/Si)s in the inorganic material A can be determined by a quantitative method (such as X-ray photoelectron spectroscopy (XPS)), which can determine the composition of a surface portion of a toner, wherein the depth of the surface portion is about tens of nanometers.

The molar ratio (MgO/SiO) in the inorganic material A is preferably from 0.8 to 2.2, and more preferably from 1.0 to 2.0. Specifically, steatite and enstatite typically have a molar ratio (MgO/SiO) of from 0.8 to 1.2 (preferably from 0.9 to 1.1), and forsterite has a molar ratio (MgO/SiO) of from 1.8 to 2.2 (preferably from 1.9 to 2.1). The molar ratio (MgO/SiO) can be determined by an X-ray diffraction analysis. Two or more of steatite, enstatite and forsterite can be mixed to adjust the molar ratio.

Since the toner of the present invention includes the inorganic material A, the toner of the present invention has the following advantages.

(1) Even when the toner is used as a full color toner which typically includes a large amount of release agent and an external additive, the filming problem or the contamination problem in that the release agent and/or additives are adhered to image forming members such as chargers and photoreceptors, resulting in formation of films thereof on the image forming members or contaminate the image forming members can be avoided.

The mechanism is considered to be as follows. Since the inorganic material A includes the above-mentioned secondary particles, particles of the inorganic material A released from the toner form a shuttering layer at the nip between the photoreceptor and a cleaning blade and thereby the amount of free release agent particles passing through the nip can be decreased. When the number average particle diameter is too small, occurrence of the filming problem cannot be well prevented. When the number average particle diameter is too large, a problem which occurs is that the photoreceptor is damaged by the particles of the inorganic material A released from the toner when the photoreceptor is cleaned with a cleaning blade or toner images are transferred from the photoreceptor to an intermediate transfer medium or a receiving material.

(2) When contact charging methods are used, the toner is hardly transferred to charging members such as charging rollers. Even when the toner is transferred to charging members, the electric resistivity of the charging members are hardly changed because the particulate inorganic material A has a high resistivity and a low dielectric constant. Therefore, the charging properties of the charging members are hardly deteriorated by the toner.

(3) Since the particulate inorganic material A includes magnesium, the inorganic material A tends to have a positive charge. Therefore, when the inorganic material A, which includes relatively large secondary particles, is released from the toner (one component developer), the inorganic material A can impart a negative charge to the toner. In a case of a two component developer, transfer of the released inorganic material A to carrier particles imparts a positive charge to the carrier particles. As a result, the charge properties (e.g., broad charge quantity distribution) of the toner can be improved even when the toner includes a large amount of release agent. In particular, the particulate inorganic material A is also preferably used for a toner, which is prepared by a wet granulation method in which toner particles are formed in an aqueous medium (e.g., polymerization toners) and which tends to have poor charging properties.

In the example embodiment of the toner of the present invention, the particulate inorganic material A is preferably added to toner particles in an amount of from 0.3 to 5.0% by weight, and more preferably from 0.5 to 3.0% by weight, based on the weight of the toner particles. When the added amount is too small, the film preventing effect can be hardly produced. In contrast, when the added amount is too large, the charging properties of the toner are seriously affected.

The particulate inorganic material A generally has a specific surface area of from 5 to 50 $m^2/g$, and preferably from 5 to 40 $m^2/g$.

The surface of the particulate inorganic material A can be treated with one or more agents such as hydrophobizing agents, amino coupling agents and aminosilicone oils, which will be explained later.

It is preferable for the example embodiment of the toner of the present invention to further include a particulate inorganic material B, which has a predetermined particle diameter and a predetermined hydrophobicity, and another particulate inorganic material C, which has a predetermined particle diameter and a predetermined hydrophobicity.

The particulate inorganic material B is preferably a hydrophobic silica having a number average primary particle diameter of form 5 nm to 20 nm, and preferably from 7 nm to 15 nm, and a hydrophobicity of from 55 to 90. By using such a particulate inorganic material B, the toner has good fluidity and thereby the half tone reproducibility of the toner can be improved. In addition, the lubricity of a cleaning blade against a photoreceptor can be improved. When the average primary particle diameter is too large, the fluidity improving effect and the lubricity improving effect are insufficiently produced. In contrast, when the average primary particle diameter is too small, the inorganic material B tends to be embedded into toner particles after repeated use, resulting in change of the fluidity improving effect and the lubricity improving effect. In addition, the environmental stability (such as high temperature preservability) of the toner deteriorates.

The particulate inorganic material C is preferably a hydrophobic silica or a hydrophobic titania having a number average particle diameter of from 20 to 100 nm, and preferably from 25 to 80 nm, and a hydrophobicity of from 55 to 90. By using such a particulate inorganic material C, occurrence of a hollow image problem in that a toner image has omissions particularly when the toner image is transferred from an intermediate transfer medium to a receiving material can be prevented. In addition, the high temperature preservability can also be improved. When the average primary particle diameter is too large, the covering rate of toner particles by the inorganic material C decreases and thereby the hollow image preventing effect and the high temperature preservability improving effect can be hardly produced. In contrast, when the average primary particle diameter is too small, the inorganic material C tends to be embedded into toner particles by the agitation stress in a developing device, and thereby aggregates of the toner particles are easily formed, resulting in formation of the hollow image problem.

Silica and titania can be used for the inorganic material C. When the toner is used for a two-component developer, a titania is preferably used as the inorganic material C to prevent occurrence of a charge-up problem in that the charge quantity of the toner is seriously increased particularly under low temperature and low humidity conditions. In order to control the charge quantity and environmental charge stability of the toner, a combination of a silica and a titania can be used as the inorganic material C. Specific examples of titania include anatase-type titania, rutile-type titania and amorphous titania.

The total added amount of the inorganic materials B and C is preferably from 2 to 5% by weight, and more preferably from 2 to 3.5% by weight, based on the weight of the toner particles. When the total added amount is too small, the hollow image problem preventing effect can be hardly produced. When the total added amount is too large, the filming problem (or the contamination problem) in that particles of the inorganic materials B and C released from the toner adhere to image forming members such as photoreceptors and chargers, resulting in formation of a film thereon (or contamination of the image forming members) is easily caused.

The weight ratio B/C of the inorganic material B to the inorganic material C is preferably from 1/9 to 7/3, and more preferably from 1/4 to 3/2. When the ratio is too large, the hollow image problem preventing effect can be hardly produced. In contrast, when the ratio is too small, the toner fluidity improving effect can be hardly produced. In addition, when the toner is used for one-component developing methods, a problem in that a thin toner layer cannot be formed on a developing roller due to poor fluidity of the toner occurs.

As mentioned above, each of the surfaces of the inorganic materials B and C is preferably treated with a hydrophobizing agent. Specific examples of the hydrophobizing agents include silane coupling agents, titanate coupling agents, silicone oils, silicone varnishes, etc. Specific examples of the silane coupling agents include hexamethyldisilazane, trimethylsilane, trimethylchlorosilane, dimethyldichlorosilane, methyltrichlorosilane, aryldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloyloxypropyltrimethoxysilane, vinyltriacetoxysilane, etc.

Specific examples of the silicone oils include dimethyl polysiloxane, methylhydrodiene polysiloxane, methylphenyl polysiloxane, etc.

When the surfaces of the inorganic materials B and C are treated, for example, the following dry method is used:

(1) a hydrophobizing agent which is diluted with a solvent is added to an inorganic material to be mixed;
(2) the mixture is heated to be dried; and
(3) blocks of the dried mixture are dissociated to prepare a hydrophobized inorganic material.

Alternatively, the following wet method can also be used:

(1) an inorganic material is dispersed in an aqueous medium to prepare a slurry;
(2) a hydrophobizing agent is added to the slurry to be mixed;
(3) the mixture is heated to be dried; and
(4) blocks of the dried mixture are dissociated to prepare a hydrophobized inorganic material.

Among these dry and wet methods, the wet method is preferably used for titania because a uniform surface treatment can be performed and formation of aggregates of the inorganic material can be prevented.

In the present application, the hydrophobicity of an inorganic material is determined by the following methanol-wettability method:

(1) methanol is added to a mixture of 0.2 g of a sample (i.e., a hydrophobic inorganic material) with 50 ml (Vw) of water in a 200 ml-beaker while agitating the mixture; and (2) when all the particles of the sample are wet by the mixture solvent of water and methanol (i.e., all the particles are dispersed in the mixture solvent with no particles floating on the surface of the mixture solvent), the total volume (Vm in units of ml) of methanol is determined.

The hydrophobicity is defined by the following equation:

$$\text{Hydrophobicity of the sample}=[Vm/\{(50)+(Vm)\}]\times 100$$

Another example embodiment of the toner of the present invention includes toner particles including at least a binder resin and a colorant and a magnesium silicate compound having a formula of $Mg_xSi_yO_{(x+2y)}$, which has a surface treated with a fatty acid, which serves as an external additive. In the formula, each of x and y is an integer. Suitable materials for use as the magnesium silicate compound include forsterite ($Mg_2SiO_4$), steatite and enstatite (each $MgSiO_3$). Particularly, forsterite is preferably used.

The magnesium silicate compound is used for improving the charge properties of the toner, and preferably has a specific dielectric constant of from 2 to 10 and preferably from 3 to 9, and a volume resistivity of not less than $10^{11}$ Ω·cm and preferably not less than $10^{12}$ Ω·cm. When the specific dielectric constant is too low, the charge properties of the toner cannot be sufficiently improved. When the specific dielectric constant is too large, the toner has too large a charge quantity and the toner is unevenly charged. When the resistivity is too low, the surface resistivity of the charging member decreases when the toner is adhered to the charging member, resulting in occurrence of defective charging of the image bearing member (photoreceptor).

The magnesium silicate compound preferably has an average primary particle diameter of from 0.05 to 0.15 μm, more preferably from 0.05 μm to 0.12 μm, and even more preferably from 0.06 μm to 0.12 μm. The average secondary particle diameter thereof is preferably from 0.2 μm to 0.6 μm, more preferably from 0.2 μm to 0.5 μm, and even more preferably from 0.2 μm to 0.4 μm.

When the average secondary particle diameter is too large, the adhesiveness of the magnesium silicate compound to toner particles is weak, and thereby the compound is easily released from the toner particles. Therefore, carriers, toner layer thickness controlling members, image bearing members are easily contaminated by the released magnesium silicate compound. In contrast, when the average primary particle diameter is too small, the magnesium silicate compound tends to be embedded into the toner particles due to the stresses applied to the toner in the developing device and the stresses applied by other members such as developing rollers and toner layer thickness controlling member, resulting in increase of the charge quantity of the toner particles and uneven charging of the toner. Therefore, the toner tends to form aggregates due to electrostatic agglomeration, and thereby a streak is formed in the toner layer on the developing roller. In addition, a toner leakage problem in that a supplied toner is released from the developing roller easily occurs.

The added amount of the magnesium silicate compound treated with a fatty acid is from 0.1 to 5.0 parts by weight, preferably from 0.2 to 3.0 parts by weight, and more preferably from 0.2 to 2.5 parts by weight, per 100 parts by weight of the toner particles. When the added amount is too small, the effects of the magnesium silicate compound cannot be produced. When the added amount is too large, the charging properties of the toner seriously deteriorate, resulting in occurrence of the toner leaking problem and toner scattering problem.

The magnesium silicate compound for use in the toner of the present invention can be prepared, for example, by the method described in JP-A 2003-327470 incorporated herein by reference.

The magnesium silicate compound having the above-mentioned formula, particularly, forsterite and steatite, has a weak adhesiveness against metals. Therefore, when the toner layer thickness controlling member (e.g., blades or rollers) is made of a metal, the toner is hardly adhered to the toner layer thickness controlling member, resulting in prevention of occurrence of the filming problem. Among the magnesium silicate compounds, forsterite is preferably used.

Forsterite tends to positively charge. Therefore, forsterite tends to be strongly attracted by a negatively charged non-image area of a photoreceptor, and thereby forsterite easily passes through a cleaning blade for cleaning the surface of the photoreceptor. In addition, since a charger charging the photoreceptor has negative charges, forsterite tends to be strongly adhered to the charger. In order to prevent occurrence of such problems, the surface of the magnesium silicate compound is preferably treated with a fatty acid. In this case, the charging property of the magnesium silicate compound is changed from a positive side toward a negative side. Therefore, the adhesiveness of the compound to a photoreceptor can be decreased and thereby the compound released from the toner particles can be easily collected by a cleaning blade. Even when the free compound passes through a cleaning blade, the compound is hardly adhered to a charger because of having a charge on the negative side.

Fatty acids for use in the surface treatment of the magnesium silicate compound have the following formula:

$$C_nH_{2n+1}COOH$$

wherein n is an integer of from 10 to 25 and preferably from 15 to 20.

When n is too small, the fatty acids are easily melted at a relatively low temperature, and thereby the toner tends to agglomerate, resulting in deterioration of image qualities. When n is too large, it is difficult to perform a surface treatment on the magnesium silicate compound using the material because salts of such higher fatty acids are hardly soluble in water.

Specific examples of the fatty acids include lauric acid, tridecanoic acid, myristic acid, pentadecanoic acid, palmitic acid, heptadecanoic acid, stearic acid, nonadecanoic acid, arachic acid, etc. Among these materials, lauric acid, palmitic acid, and stearic acid are preferably used.

By using a magnesium silicate compound having a surface treated with one or more of the above-mentioned fatty acids at a specific ratio, the resultant toner has good charging properties and occurrence of the charger contamination problem can be prevented.

The weight ratio (F/M) of the fatty acid (F) to the magnesium silicate compound (M) is from 0.5/100 to 8/100 and preferably from 1/100 to 5/100. When the content of the fatty acid is too low, the effects of the fatty acid cannot be produced. When the content is too high, the quantity of free fatty acid, which is not adhered to the magnesium silicate compound, increases, and thereby the free fatty acid forms a film on the photoreceptor.

The method for treating a magnesium silicate compound with a fatty acid is, for example, as follows. At first, a magnesium silicate compound is dispersed in pure water. Then an alkali is added thereto so that the dispersion becomes alkaline. Then a salt of a fatty acid is added to the dispersion while heating the dispersion to deposit a fatty acid on the surface of the magnesium silicate compound.

The toner particles of the toner of the present invention include at least a binder resin, a colorant and an optional release agent.

Suitable resins for use as the binder resin include known resins for use in conventional toners, which can be used for electrophotography and electrostatic printing. Specific examples of the resins include styrene resins, acrylic resins such as (meth)acrylate resins, styrene-acrylic copolymers, polyester resins, silicone resins, olefin resins, amide resins, epoxy resins, etc.

When the toner is used as a toner for color image forming apparatuses using an oil-less fixing method, the binder resin preferably includes a first binder resin including a high molecular weight elastic resin component and a second binder resin including a low molecular weight resin component having a sharp melting property. In this case, good releasability from fixing members can be imparted to the toner and the fixed toner images have high glossiness.

The first and second binder resins are not particularly limited, and known binder resins for use in conventional full color toners can be used.

Specific examples thereof include polyester resins, (meth) acrylicresins, styrene-(meth)acryliccopolymers, epoxy resins, cyclic olefin resins (e.g., TOPAS-COC (from Ticona)), etc. Among these resins, polyester resins are preferably used because of having good resistance to stresses applied to the toner in a developing device.

Suitable polyester resins for use in the toner of the present invention include polyester resins which are prepared by subjecting a polyhydric alcohol and a polycarboxylic acid to a polycondensation reaction. Specific examples of dihydric alcohols for use as the polyhydric alcohol include alkylene oxide adducts of bisphenol A such as polyoxypropylene(2, 2)-2,2-bis(4-hydroxyphenyl)propane, polyoxypropylene(3, 3)-2,2-bis(4-hydroxyphenyl)propane, polyoxypropylene(6)-2,2-bis(4-hydroxyphenyl)propane, and polyoxypropylene(2, 0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenated bisphenol A, etc. Specific examples of tri- or more hydric alcohols include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropane triol, 2-methyl1,2,4-butanetriol, trimethylol ethane, trimethylol propane, 1,3,5-trihydroxymethyl benzene, etc.

Specific examples of dicarboxylic acids for use as the polycarboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, iso-dodecenylsuccinic acid, n-octenylsuccinic acid, iso-octenylsuccinic acid, n-octylsuccinic acid, iso-octylsuccinic acid, anhydrides or low alkyl esters of these acids, etc.

Specific examples of tri- or more carboxylic acids for use as the polycarboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra (methylenecarboxy)methane, 1,2,7,8-octanetetracarboxylic acid, pyromellitic acid, trimer acids of embole, anhydrides or low alkyl esters of these acids, etc.

In addition, vinyl-polyester resins which are prepared by mixing monomers of a polyester resin, one or more monomers of a vinyl resin, and one or more monomers which are reactive with both the monomers of the polyester resin and the monomers of the vinyl resin, and subjecting the monomers to a polycondensation reaction (to prepare the polyester resin) and a radical reaction (to prepare the vinyl resin) at the same time can also be used as the polyester resin. The monomers which are reactive with the monomers of the polyester resin and the monomers of vinyl resin are monomers which can be used for both a polycondensation reaction and a radical reaction, i.e., monomers which have both a carboxyl group which can cause a polycondensation reaction and a vinyl group which can cause a radical reaction. Specific examples of such monomers include fumaric acid, maleic acid, acrylic acid, methacrylic acid, etc.

Specific examples of the monomers for use in preparing the polyester component of the vinyl-polyester resins include the polyhydric alcohols and polycarboxylic acids mentioned above. Specific examples of the monomers for use in preparing the vinyl resin component of the vinyl-polyester resins include styrene and derivatives thereof such as styrene, o-methylstyrene, m-methylstyrene, p-methylstyrene, α-methylstyrene, p-ethylstyrene, 2,4-dimethylstyrene, p-tert-butylstyrene, and p-chlorostyrene; ethylene-type unsaturated monoolefins such as ethylene, propylene, butylene, and isobutylene; alkyl esters of methacrylic acid such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, and dodecyl methacrylate; alkyl esters of acrylic acid such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid; acrylonitrile, esters of maleic acid, esters of itaconic acid, vinyl chloride, vinyl acetate, vinyl benzoate, vinyl methyl ketone, vinyl ethyl ketone, vinyl hexyl ketone, vinyl methyl ether, vinyl ethyl ether, and vinyl isobutyl ether.

Specific examples of the polymerization initiators for use in polymerizing the vinyl monomers include azo-type or diazo-type initiators such as 2,2'-azobis(2,4-dimethylvaleronitrile), 2,2'-azobisisobutylonitrile, 1,1'-azobis(cyclohexane-1-carbonitrile), and 2,2'-azobis-4-methoxy-2,4-dimethylvaleronitrile; and peroxide-type initiators such as benzoyl peroxide, dicumyl peroxide, methyl ethyl ketone peroxide, isopropyl peroxy carbonate, and lauroyl peroxide.

The above-mentioned polyester resins are preferably used as the binder resin of the toner of the present invention. In order that the toner can be used for oil-less fixing methods, the toner preferably has a good combination of releasability and offset resistance. In order to impart a good combination of releasability and offset resistance to the toner, a combination of a first binder resin and a second binder resin is used for the binder resin.

Suitable resins for use as the first binder resin include polyester resins which are prepared by subjecting a polyhydric alcohol and a polycarboxylic acid to a polycondensation reaction, and preferably polyester resins which are prepared by subjecting an alkylene oxide adduct of bisphenol A (a polyhydric alcohol) and terephthalic acid or fumaric acid (a polycarboxylic acid) to a polycondensation reaction.

Suitable resins for use as the second binder resin include vinyl-polyester resins, and preferably vinyl-polyester resins which are prepared by using an alkylene oxide adduct of bisphenol A, terephthalic acid, trimellitic acid and succinic acid as monomers for forming a polyester resin component; styrene and butyl acrylate as monomers for forming a vinyl resin component; and fumaric acid as a monomer for use in both the polycondensation reaction and radical polymerization reaction.

In order to increase the added amount of the release agent in the toner to impart good oil-less fixing property to the toner, it is preferable to internally add a release agent to the binder resin. A release agent can be internally added to the first or second binder resin. However, when the toner is prepared by a pulverization method, a release agent is preferable added to the first binder resin because a high shearing force is applied to the kneading process in which the first binder resin is kneaded.

The method of internally adding a release agent to the first binder resin is as follows.

When the first binder resin is synthesized, a release agent is added to the resin. Namely, a release agent can be internally added to the first binder resin by polymerizing a mixture of monomers for constituting the first binder resin with the release agent. Specifically, a mixture of an acid monomer, an alcoholic monomer and a release agent such as a hydrocarbon wax is subjected to a polycondensation reaction. When the first binder resin is a vinyl-polyester resin, the following method is preferably used:

(1) a mixture of monomers for constituting a polyester resin component with a hydrocarbon wax is heated while agitated to perform a polycondensation reaction; and
(2) one or more monomers for constituting a vinyl resin component are dropped into the mixture to perform a radical polymerization reaction.

The weight ratio (b1/b2) of the first binder resin (including a wax) (b1) to the second binder resin (b2) is preferably from 20/80 to 45/55, and more preferably from 30/70 to 40/60. When the content of the first binder resin is too low, the releasability and hot offset resistance of the toner deteriorate. In contrast, when the content is too high, the glossiness of images and high temperature preservability of the toner deteriorate.

The binder resin of the toner of the present invention, which preferably includes a first binder resin (including a wax) and a second binder resin, preferably has a softening point of from 100 to 125° C., and more preferably from 105 to 125° C.

Specific examples of the release agent of the toner of the present invention include polyethylene waxes, polypropylene waxes, carnauba waxes, rice waxes, SASOL waxes, montan ester waxes, Fischer Tropsch waxes, paraffin waxes, etc.

When the toner is used as a color toner for image forming apparatuses using an oil-less fixing method, a release agent is included as an essential component and the melting point of the release agent is preferably from 60 to 100° C., and more preferably from 70 to 90° C. For example, fatty acid esters, low molecular weight polyethylene, carnauba waxes and paraffin waxes having such a melting point can be preferably used therefor. Among these release agent, paraffin waxes are preferably used. When the melting point is too low, the hot offset improving effect can be hardly produced. In contrast, when the melting point is too high, the release agent is not well dispersed in a binder resin, and thereby a filming problem in that a film of the release agent is formed on the surface of the photoreceptor used is caused.

The content of the release agent in the toner is generally from 3.5 to 10% by weight, and preferably from 4 to 8% by weight, based on the weight of the toner particles, when the toner is a pulverization toner. When the content is too low, the releasing effect can be hardly produced. In contrast, when the content is too high, the release agent is not well dispersed in the binder resin, resulting in formation of a free release agent and thereby the filming problem is caused.

When the toner is prepared by a wet granulation method, it is easy to include a release agent in toner particles and to control the location of the release agent in the toner particles, for example, using a technique such as capsule methods. In addition, such a granulation toner has sufficient margin for the content of the release agent. Therefore, the content of the release agent in the toner can be increased so as to be from 5 to 12% by weight based on the weight of the toner particles.

Known pigments and dyes for use in conventional color toners can be used as the colorant of the toner of the present invention. Specific examples of the pigments and dyes include carbon black, Aniline Blue, chalco-oil blue, chrome yellow, ultramarine blue, DUPONT OIL RED, Ouinoline Yellow, Methylene Blue chloride, Copper Phthalocyanine, Malachite Green oxalate, lamp black, Rose Bengale, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1, C.I. Pigment Blue 15:3, etc.

The colorant is preferably used as a master batch which is prepared by dispersing a pigment in a resin at a high concentration by kneading a mixture of the resin and the colorant or by subjecting the colorant to a flushing treatment. The content of the colorant in the toner is preferably 2 to 15 parts by weight based on 100 parts by weight of the total weight of the binder resin.

The toner particles of the toner of the present invention can include one or more additives such as charge controlling agents. Specific examples of the negative charge controlling agents include chromium complex salt type azo dyes such as S-32, S-33, S-34, S-35, S-37, S-38, S-40 (from Orient Chemical Industries Co., Ltd.), AIZEN SPILON BLACK TRH and BHH (from Hodogaya Chemical Co., Ltd., and KAYASET BLACK T-22 and 004 (from Nippon Kayaku Co., Ltd.; copper phthalocyanine dye S-39 (from Orient Chemical Industries Co., Ltd.); chromium complex salts such as E-81 and 82 (from Orient Chemical Industries Co., Ltd.); zinc complex salts such as E-84 (from Orient Chemical Industries Co., Ltd.); aluminum complex salts such as E-86 (from Orient Chemical Industries Co., Ltd.); boron complex salts of benzyl acid derivatives such as LR-147 (from Japan Carlit Co., Ltd.); fluorine-containing quaternary ammonium salts; calixarene compounds; etc.

The negative charge controlling agents used for full color toners are preferably colorless or have a pale color so that the color tone and transparency of the color toner are not deteriorated. Suitable compounds therefor include metal complexes (such as zinc and chromium complexes) of salicylic acid derivatives, calixarene compounds, organic boron complex salts of benzyl acid derivatives, fluorine-containing quaternary ammonium salts, etc. Specific examples of the metal complexes of salicylic acid derivatives include the materials disclosed in JP-As 53-127726 and 62-145255, incorporated herein by reference. Specific examples of the calixarene compounds include the materials disclosed in JP-A 02-201378, incorporated by reference. Specific examples of the organic boron compounds include the materials disclosed in JP-A 02-221967, incorporated herein by reference. Specific examples of the fluorine-containing quaternary ammonium salts include the materials disclosed in JP-A 03-1162, incorporated herein by reference.

The toner particles can be prepared by any known toner manufacturing methods such as dry methods (e.g., pulverization methods) and wet methods (e.g., emulsion methods, suspension methods, and solution suspension methods (i.e., emulsion granulation methods)). In general, toner particles prepared by a pulverization method have irregular forms, and toner particles prepared by a wet method have spherical forms. It is preferable to use a proper toner preparation method such that the resultant toner is suitable for the image forming process of the target image forming apparatus.

The toner particles of the toner of the present invention preferably have a volume average particle diameter of from 4 to 9 μm, and preferably from 4 to 8 μm, to produce high quality images.

When the toner particles are prepared by a pulverization method, known pulverization methods can be used. For example, the methods include:

(1) mechanically mixing a binder resin, a colorant and a release agent (which can be previously included in the binder resin);
(2) melt-kneading the mixture;
(3) pulverizing the kneaded mixture; and
(4) classifying the pulverized mixture.

In these methods, coarse particles and fine particles removed in the classifying process can be reused for the mixing process or the melt kneading process.

When the toner particles are prepared by an emulsion polymerization aggregation method, known methods can be used. For example, the methods include:

(1) dissolving or dispersing a release agent in a vinyl monomer;
(2) subjecting the mixture to a mini-emulsion polymerization treatment to prepare an emulsion of a vinyl resin including the release agent therein;
(3) subjecting the vinyl resin emulsion to a aggregation/fusion treatment together with a pigment dispersion, etc., to prepare a toner slurry; and
(4) subjecting the toner slurry to washing and filtration, followed by drying to prepare toner particles.

By using the emulsion polymerization aggregation methods, the shape of the toner particles can be controlled relatively freely compared with the pulverization methods, and toner particles having a shape of from potato forms to spherical forms can be produced.

The solution suspension methods for use in preparing toner particles of the present invention include:

(1) dissolving or dispersing a toner composition including a binder resin in an organic solvent to prepare a toner composition liquid;
(2) dispersing the toner composition liquid in an aqueous medium to prepare an emulsion; and
(3) subjecting the emulsion to a granulation treatment.

Recently, an improved solution suspension extension method is disclosed in JP-A 2004-139003 incorporated herein by reference. The method includes (1) dissolving or dispersing a toner composition mixture including a prepolymer in an organic solvent to prepare a toner composition mixture;
(2) dispersing the toner composition mixture in an aqueous medium to prepare an emulsion; and
(3) subjecting the emulsion to a crosslinking reaction and/or a polymer chain growing reaction to prepare toner particles.

By using this method, polyester resins, which cannot be used for emulsion polymerization methods and suspension polymerization methods, can be used therefor. Therefore, color toners having a good fixability can be prepared. In addition, the molecular weight of the binder resin can be easily controlled by subjecting a prepolymer to a polymer chain growing reaction to form a urethane/urea bond. Therefore, this toner preparation method is useful for preparing a toner for full color image forming apparatuses using an oil-less fixing method.

The thus prepared toner particles are mixed with the particulate inorganic material, which is preferably coated with a fatty acid, the particulate inorganic materials A or a combination of the particulate inorganic materials A, B and C. In this case, a dry mixing method using a mixer such as HENSCHEL MIXER is preferably used. After the mixing treatment, the toner is preferably sieved using a screen having openings of not greater than 100 μm to remove foreign particles and coarse particles therefrom.

The toner of the present invention can be used as a monochrome toner, a color toner, a one-component developer and a toner for two-component developers. Among these applications, the toner is preferably used for full color image forming methods using an oil-less fixing method.

Next, the image forming apparatus of the present invention will be explained.

The image forming apparatus of the present invention includes at least a rotatable image bearing member configured to bear a toner image thereon; a latent image forming device including a charger, which is configured to form an electrostatic latent image on the surface of the image bearing member; and a developing device which includes, for example, a rotatable toner feeding member and a toner supplying member and which is configured to develop the electrostatic latent image with a developer including the toner of the present invention to form the toner image on the image bearing member.

FIG. 1 is a schematic view illustrating an image forming apparatus for use in the image forming method of the present invention.

The image forming apparatus includes a photoreceptor 1 serving as an image bearing member, a charging device 2 configured to charge the photoreceptor 1, a light irradiating device 10 configured to irradiate the charged photoreceptor with imagewise light to form an electrostatic latent image on the photoreceptor, four developing devices 11-14 configured to develop the electrostatic latent image with a yellow, magenta, cyan or black color toner, a cleaning device 18 configured to remove residual toner particles remaining on the photoreceptor, a discharging device 19 configured to discharge a residual charge remaining on the photoreceptor even after the toner images are transferred onto the intermediate transfer medium, an intermediate transfer medium 15 configured to receive the color toner images from the photoreceptor, and a transferring device 17 configured to transfer the toner images on the intermediate transfer medium 15 to a receiving material 16. In this regard, the charging device and the light irradiating device are sometimes referred to an image forming device configured to form an electrostatic latent image on the photoreceptor.

In the color image forming apparatus illustrated in FIG. 1, different color images (such as yellow, magenta, cyan and black color images) are formed by the four developing devices 11-14 and the color images are overlaid on the intermediate transfer medium 15. The thus overlaid color images are transferred to the receiving material 16 at the same time by the transferring device 17. The thus transferred color images are fixed with a fixing device 20, resulting in formation of a full color image. The image forming order is particularly not limited.

The developing devices 11-14 use the toner of the present invention and includes a developing roller 21 serving as a developer feeding member and a toner layer thickness controlling member 22.

The image forming apparatus is not limited thereto, and four photoreceptors can be used instead of the photoreceptor 1 for forming yellow, magenta, cyan and black color toner images thereon. In addition, the toner images on the photoreceptor can be directly transferred to the receiving material without using the intermediate transfer medium.

Figure 2:
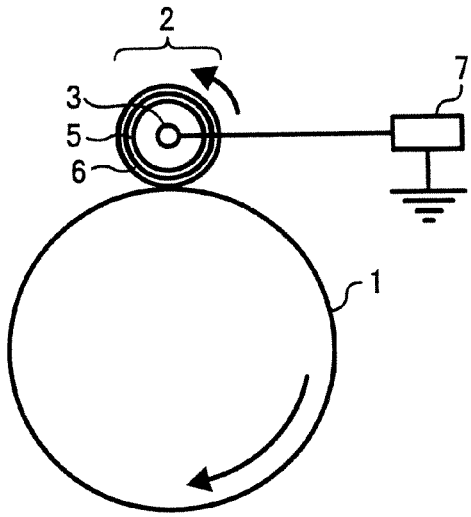
FIG. 2 is a schematic view illustrating a charging device and an image bearing member for use in an example of the image forming apparatus of the present invention.

An example of the charger for use in the image forming apparatus of the present invention is illustrated in FIG. 2. As illustrated in FIG. 2, the charging device includes a charging member 2 having a metal core 3, an electroconductive layer 5 located on the metal core, and an outermost layer 6 located on the electroconductive layer. The charging member typically has a cylindrical form. A voltage applied to the metal core 3 by a power source 7 is applied to an image bearing member 1 (e.g., a photoreceptor) via the electroconductive layer 5 and the outermost layer 6, and thereby the surface of the image bearing member 1 is charged.

The metal core 3 of the charging member 2 extends in the longitudinal direction of the image bearing member 1 so as to be parallel to the image bearing member. The charging member 2 is pressed to the image bearing member 1 at a predetermined pressure, and thereby a surface of the image bearing member is contacted with a surface of the charging member 2 in the longitudinal direction thereof, resulting in formation of a nip. The image bearing member 1 is rotated by a driving device (not shown), and thereby the charging member 2 is rotated by the image bearing member 1.

Charging of the image bearing member 1 with the charging member 2 to which a voltage is applied by the power source 7 is performed through the nip and the vicinity of the nip. Since the surface of the charging member 2 is evenly contacted with the surface of the image bearing member, the surface of the image bearing member is uniformly charged.

The electroconductive layer 5 of the charging member 2 is made of a nonmetallic material. In order that the charging member 2 is stably contacted with the image bearing member 1, the nonmetallic material preferably has a low hardness. Specific examples of the nonmetallic material having a low hardness include resins such as polyurethane, polyether, and polyvinyl alcohol; rubbers such as ethylene-propylene-diene-methylene (EPDM), and nitrile-butadiene rubber (NBR). Specific examples of the electroconductive materials to be included in the electroconductive layer 5 include carbon black, graphite, titanium oxide, zinc oxide, etc.

The outermost layer 6 includes a material having a medium resistance of from $10^2$ to $10^{10}\Omega$. Specific examples of the material include resins such as nylon, polyamide, polyimide, polyurethane, polyester, silicone, fluorine-containing resins (e.g., TEFLON (Tradename)), polyacetylene, polypyrrole, polythiophene, polycarbonate, vinyl resins, etc. Among these materials, fluorine-containing resins are preferably used to increase the contact angle of the outermost layer against water. Specific examples of the fluorine-containing resins include polyvinylidene fluoride, polyethylene fluoride, vinylidene fluoride-tetrafluoroethylene copolymers, vinylidene fluoride-tetrafluoroethylene-hexafluoropropylene copolymers, etc. Specific examples of the electroconductive materials to be included in the outermost layer 6 include carbon black, graphite, titanium oxide, zinc oxide, tin oxide, iron oxide, etc.

Figure 3:
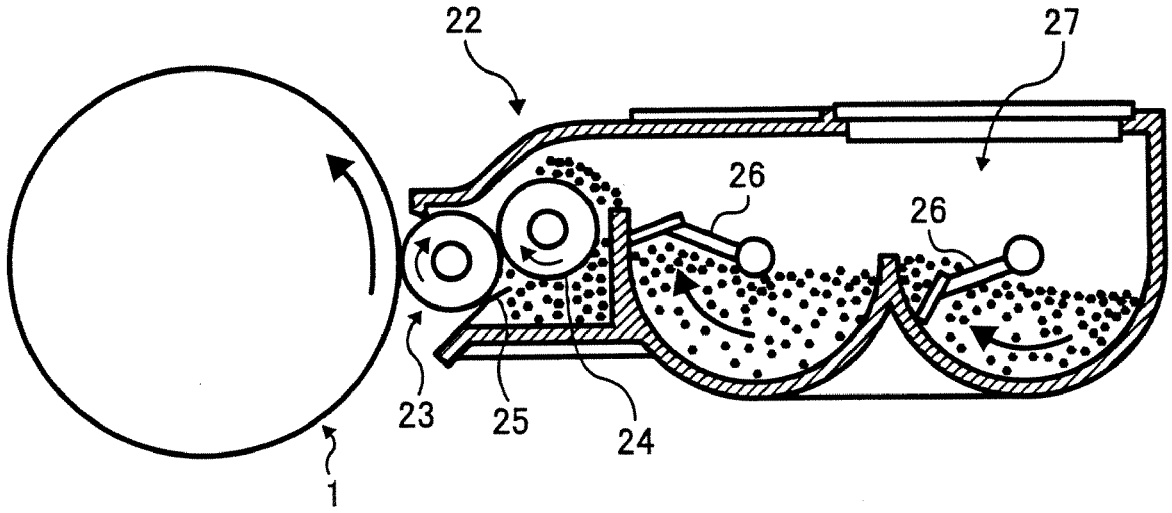
FIG. 3 is a schematic view illustrating a developing device and an image bearing member for use in an example of the image forming apparatus of the present invention.

FIG. 3 illustrates an example of the developing device for use in the image forming apparatus of the present invention. In this image forming apparatus, the image bearing member 1 rotates in a direction indicated by an arrow. In FIG. 3, a developing device 22 includes a developing roller 23 which is contacted with the image bearing member 1 or faces the image bearing member with a gap of from 0.1 to 0.3 mm and which is rotated in a direction indicated by an arrow. In addition, a toner supplying roller 24 configured to supply the toner to the developing roller, and a toner layer thickness controlling member 25 which is a plate spring to which a blade of a rubber (such as urethane rubbers and silicone rubbers) is attached or which a blade of a metal such as stainless steels are provided in the vicinity of the developing roller 23. Further, rotatable toner feeding shafts 26 are provided in a toner containing room 27 to feed the toner to the toner supplying roller 24.

The developing roller 23 is, for example, a roller including an electroconductive shaft, an elastic rubber layer covering the electroconductive shaft and an outermost layer which cover the elastic layer and which includes a material which can be easily charged so as to have a charge with a polarity opposite to that of the toner. Suitable materials for use as the electroconductive shaft include shafts of metals such as aluminum and stainless steels whose surface is subjected to a sand blast treatment to be roughened.

The elastic rubber layer preferably has a JIS-A hardness of not greater than 60° to prevent deterioration of the toner on the developing roller due to excessive pressure applied to the toner by the toner layer thickness controlling blade. The roughness Ra (i.e., Arithmetical Mean Deviation of the Profile) of the surface of the developing roller is preferably controlled so as to be from 0.3 to 2.0 μm so that a predetermined amount of toner is borne thereon.

Since a development bias is applied between the developing roller 23 and the image bearing member 1, the elastic rubber layer of the developing roller preferably has a resistance of from $10^3$ to $10^{10}\Omega$. The toner layer thus formed on the developing roller 13 by the toner thickness controlling member is transported to the development area at which the developing roller faces the image bearing member.

The toner thickness controlling member 25 is disposed at a position lower than the contact point of the supplying roller and the developing roller. A metal plate spring made of stainless steel or phosphor bronze is used for the toner thickness controlling member. The free end of the toner thickness controlling member is pressed to the surface of the developing roller at a pressure of from 10 to 40 N/m. Therefore, when the toner passes through the nip under a pressure, a thin layer of the toner is formed while the toner layer is frictionally charged. In addition, in order to assist frictional charging of the toner layer, a bias having the same polarity as that of the charge of the toner is applied to the toner layer thickness controlling member.

Specific examples of the materials constituting the elastic rubber layer of the developing roller 13 include styrene-butadiene copolymer rubbers, acrylonitrile-butadiene copolymer rubbers, acrylic rubbers, epichlorohydrin rubbers, urethane rubbers, silicone rubbers, and mixtures of two or more thereof. Among these materials, mixture rubbers of an epichlorohydrin rubber and an acrylonitrile-butadiene copolymer rubber are preferably used.

The image forming apparatus of the present invention can includes other known image forming devices such as a light irradiating device configured to irradiate a charged surface of the image bearing member with imagewise light to form an electrostatic latent image on the image bearing member; a transfer device configured to transfer the toner image formed on the image bearing member to a receiving material optionally via an intermediate transfer medium; and a cleaning device configured to clean the surface of the image bearing member.

Next, the methods for determining the properties of the toner and the constituents thereof will be explained.

The number average secondary particle diameter of the particulate inorganic materials is determined by a laser scattering particle size distribution analyzer LA-920 from Horiba Ltd. A sample (i.e., a particulate inorganic material) is ultrasonically dispersed in an aqueous medium including a surfactant to prepare an aqueous dispersion. The particle diameter distribution and the average secondary particle diameter of the sample in the aqueous dispersion are measured using the analyzer.

The average primary particle diameter of the particulate inorganic materials is determined by observing the inorganic materials with a scanning electron microscope (SEM) or a transmission electron microscope (TEM).

The specific surface area of the particulate inorganic materials is determined by a multi point BET method. The measurements are performed using a specific surface area meter AUTOSORB 1 from QUANTACHROME INSTRUMENTS.

The softening point ($T_{1/2}$) and the flow ending point ($T_{end}$) of the toner are determined using an instrument FLOW-TESTER CFT-500D from Shimadzu Corp. The exit from which the melted and pressed toner flows has a diameter of 0.5 mm and a length of 1 mm. The temperature rising speed is 3° C./min and the pressure is 294 N (30 kgf).

The glass transition temperature (Tg) of a resin and a toner and the melting point of a release agent are determined using a differential scanning calorimeter DSC6200 from Seiko Instruments Inc. A sample is heated to 200° C. and then cooled to 0° C. at a speed of 10° C./min. Then the sample is heated again at a speed of 10° C./min to determine the glass transition temperature and the melting point thereof.

The acid value is determined using the JIS K-0070 method incorporated herein by reference. Specifically the procedure is as follows:

(1) a weighed sample (having a weight of W g) is contained in a beaker of 300 ml and mixed with 150 ml of a mixture solvent of toluene/methanol (4/1 in volume);

(2) the mixture is subjected to potentiometric titration using a 0.1M ethanol solution of KOH (for example, automatic titration can be performed using a combination of a potentiometric titration device AT-400 (win workstation) and an electric burette ABP-410, which are from Kyoto Electronics Manufacturing Co., Ltd.) to determine the consumption S (ml) of KOH;

(3) the procedure (2) is performed using a black liquid to determine the consumption B (ml) of KOH; and (4) the acid value of the sample is calculated using the following formula:

$$\text{Acid value (mgKOH/g)}=\{(S-B)\times f\times 5.61\}/W$$

wherein f represents a factor of the 0.1M ethanol solution of KOH.

The particle diameter of the toner is determined by a method using a COULTER COUNTER TA-II, a COULTER MULTISIZER II or a COULTER MULTISIZER III, which is manufactured by Beckman Coulter Inc.

The measurement method is as follows:

(1) 0.1 to 5 ml of a surfactant serving as a dispersant (preferably an aqueous solution of an alkylbenzenesulfonic acid salt) is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are determined using the instrument mentioned above and an aperture of 100 μm.

The volume average particle diameter and number average particle diameter of the toner can be determined from the thus obtained volume and number average particle diameter distributions.

The circularity of a toner particle is defined by the following equation:

$$\text{Circularity}=L_0/L$$

wherein L represents the length of the circumference of the image of a particle and $L_0$ represents the length of the circumference of a circle having the same area as that of the image of the particle.

The average circularity of the toner of the present invention is preferably from 0.96 to 1.00, and more preferably from 0.98 to 1.00, to produce images with good image density and reproducibility. The average circularity of the toner was determined by a flow-type particle image analyzer, FPIA-1000 manufactured by Sysmex Corp.

Specifically, the method is as follows:

(1) 0.1 g to 0.5 g of a sample to be measured is mixed with 100 to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per 1 micro-liter of the suspension; and (3) the average circularity and circularity distribution of the sample in the suspension are determined by the measuring instrument mentioned above.

The atomic ratio (Mg/Si) of magnesium (Mg) to silicon (Si) in the entire particulate inorganic material is determined by a fluorescent X-ray analyzer ZSX PRIMUS from Rigaku Corporation. A pellet of a sample is prepared using a binder. Then the amounts of magnesium and silicon in the pellet are determined by the above-mentioned instrument. The atomic ratio (Mg/Si) is calculated from the amounts of magnesium and silicon.

The atomic ratio (Mg/Si) of magnesium (Mg) to silicon (Si) in the surface portion of the particulate inorganic material is determined by a X-ray photoelectron spectrometer 1600S from ULVAC-PHI Inc. The measurement conditions are as follows.

X-ray source: Mg, Al (400 W)

Analysis region: 0.8 to 2.0 mm in depth

The atomic concentrations of Mg and Si in the surface portion are calculated using sensitivity factors provided by ULVAC-PHI Inc. The atomic ratio (Mg/Si) in the surface portion can be determined from the atomic concentrations of Mg and Si.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation Example 1 of Inorganic Material A

A slurry of $Mg(OH)_2$ was mixed with a $SiO_2$ powder having an average primary particle diameter of 0.02 μm so that the molar ratio ($MgO/SiO_2$) is 2/1. Thus, 150-litter of a slurry including MgO at a concentration of 71.5 g/litter and $SiO_2$ at a concentration of 53.3 g/litter was prepared. The slurry was subjected to a wet pulverization treatment using a sand grinder. The pulverization conditions were as follows.

Media used: Alumina-silica beads having a particle diameter of 0.8 mm

Filling factor of media: 80%

Slurry feeding speed: 4.0 litter/min

Number of pulverization treatments: Three times (i.e., three passes)

The thus pulverized slurry was subjected to spray drying, followed by calcination in the air for 30 minutes at 1100° C. using an electric furnace.

Then, 50-litter of a slurry including the thus calcined material at a concentration of 300 g/litter was prepared and subjected to a wet pulverization treatment using a sand grinder. The pulverization conditions were as follows.

Media used: Alumina-silica beads having a particle diameter of 0.8 mm

Filling factor of media: 80%

Slurry feeding speed: 5.6 litter/min

Number of treatments: Twice (i.e., two passes)

The thus pulverized slurry was subjected to spray drying, followed by pulverization using a sand mill. Thus, a particulate inorganic material A-1 was prepared.

As a result of X-ray diffraction analysis of the particulate inorganic material A-1, it was found that the material is made of a single phase of forsterite and has the following properties.

Average primary particle diameter: 0.10 μm

Specific surface area: 18.9 $m^2/g$

Average secondary particle diameter: 0.39 μm

Mg/Si atomic ratio in the entire toner: 2.05

Mg/Si atomic ratio in the surface portion of toner: 2.05

Preparation Example 2 of Inorganic Material A

The procedure for preparation of the inorganic material A-1 was repeated except that after the wet pulverization process, hydrochloric acid was added to the slurry to subject the mixture of the inorganic pigments.

Thus, a particulate inorganic material A-2 was prepared.

As a result of X-ray diffraction analysis of the particulate inorganic material A-2, it was found that the material is made of a single phase of forsterite and has the following properties.

Average primary particle diameter: 0.11 μm

Specific surface area: 19.0 $m^2/g$

Average secondary particle diameter: 0.40 μm

Mg/Si atomic ratio in the entire toner: 2.05

Mg/Si atomic ratio in the surface portion of toner: 1.64

Preparation Example 3 of Inorganic Material A

The procedure for preparation of the inorganic material A-2 was repeated except that the calcination temperature was changed to 1200° C.

Thus, a particulate inorganic material A-3 was prepared.

As a result of X-ray diffraction analysis of the particulate inorganic material A-3, it was found that the material is made of a single phase of forsterite and has the following properties.

Average primary particle diameter: 0.16 μm

Specific surface area: 10.3 $m^2/g$

Average secondary particle diameter: 1.5 μm

Mg/Si atomic ratio in the entire toner: 2.01

Mg/Si atomic ratio in the surface portion of toner: 1.77

Preparation Example 4 of Inorganic Material A

The procedure for preparation of the inorganic material A-2 was repeated except that the molar ratio $MgO/SiO_2$ was changed to 1/1 and the concentrations of MgO and $SiO_2$ in the 150-litter slurry were changed to 35.8 g/litter and 53.3 g/litter, respectively.

Thus, a particulate inorganic material A-4 was prepared.

As a result of X-ray diffraction analysis of the particulate inorganic material A-4, it was found that the material is made of a single phase of enstatite and has the following properties.

Average primary particle diameter: 0.09 μm

Specific surface area: 20.5 $m^2/g$

Average secondary particle diameter: 0.40 μm

Mg/Si atomic ratio in the entire toner: 1.01

Mg/Si atomic ratio in the surface portion of toner: 0.68

Preparation Example 5 of Inorganic Material A

The procedure for preparation of the inorganic material A-1 was repeated except that the calcination temperature was changed to 1200° C. Thus a particulate inorganic material A-5 was prepared.

As a result of X-ray diffraction analysis of the particulate inorganic material A-5, it was found that the material is made of a single phase of forsterite and has the following properties.

Average primary particle diameter: 0.15 μm

Specific surface area: 10.5 $m^2/g$

Average secondary particle diameter: 1.7 μm

Mg/Si atomic ratio in the entire toner: 2.05

Mg/Si atomic ratio in the surface portion of toner: 2.05

Preparation Example 6 of Inorganic Material A

The procedure for preparation of the inorganic material A-1 was repeated except that the molar ratio $MgO/SiO_2$ was changed to 1/1 and the concentrations of MgO and $SiO_2$ in the 150-litter slurry were changed to 35.8 g/litter and 53.3 g/litter, respectively.

Thus, a particulate inorganic material A-6 was prepared.

As a result of X-ray diffraction analysis of the particulate inorganic material A-6, it was found that the material is made of a single phase of enstatite and has the following properties.

Average primary particle diameter: 0.09 μm

Specific surface area: 20.5 $m^2/g$

Average secondary particle diameter: 0.40 μm

Mg/Si atomic ratio in the entire toner: 1.01

Mg/Si atomic ratio in the surface portion of toner: 1.01

Preparation Example 1 of Toner Particles

Preparation of the First Binder Resin

The following components were mixed in a dropping funnel.

| Vinyl monomers | |
|---|---|
| Styrene | 600 g |
| Butyl acrylate | 110 g |
| Acrylic acid | 30 g |
| Dicumylperoxide (polymerization initiator) | 30 g |

The following components were contained in a four necked 5-liter flask equipped with a thermometer, a stainless stirrer, a condenser, and a nitrogen feed pipe.

| Monomers for polyester resin | |
|---|---|
| Polyoxypropylene(2,2)-2,2-bis(4-hydroxylphenyl)propane | 1230 g |
| Polyoxyethylene(2,2)-2,2-bis(4-hydroxylphenyl)propane | 290 g |
| Isododecenylsuccinic anhydride | 250 g |
| Terephthalic acid | 310 g |
| 1,2,4-benzenetricarboxylic acid anhydride | 180 g |
| Dibutyl tin oxide (esterification catalyst) | 7 g |

The components in the four-necked flask were heated to 160° C. by a mantle heater while agitated with the stirrer. In addition, the components in the dropping funnel was dropped in the flask over one hour. After the mixture was heated for 2 hours at 160° C. to complete an addition polymerization reaction, the reaction product was heated to 230° C. to perform a polycondensation reaction. The polymerization degree of the reaction product was occasionally checked using a constant-pressure orifice rheometer. When the reaction product had a desired softening point, the polycondensation reaction was ended. Thus, a resin H1 having a softening point ($T_{1/2}$) of 130° C. was prepared.

Preparation of Second Binder Resin

The following components were contained in a four necked 5-liter flask equipped with a thermometer, a stainless stirrer, a condenser, and a nitrogen feed pipe.

| Monomers for polyester resin | |
|---|---|
| Polyoxypropylene(2,2)-2,2-bis(4-hydroxylphenyl)propane | 1650 g |
| Polyoxyethylene(2,2)-2,2-bis(4-hydroxylphenyl)propane | 660 g |
| Isododecenylsuccinic anhydride | 190 g |
| Terephthalic acid | 750 g |
| 1,2,4-benzenetricarboxylic acid anhydride | 190 g |
| Dibutyl tin oxide (esterification catalyst) | 0.3 g |

The procedure for preparation of the resin H1 was repeated. Thus, a resin L1 having a softening point of 113° C. was prepared.

Preparation of Toner Particles

The following components were mixed with a blender.

| | |
|---|---|
| First binder resin H1 | 70 parts |
| Second binder resin L1 | 30 parts |
| Paraffin wax (melting point: 73.3° C.) | 5 parts |
| Copper phthalocyanine bluepigment | 2.5 parts |

The mixture was then melted and kneaded with a pressurized kneader. The kneaded mixture was then cooled. The cooled mixture was pulverized with a mechanical pulverizer, followed by classification. Thus, cyan toner particles 1 having an average particle diameter of 7.0 μm were prepared.

The cyan toner particles 1 had the following properties.

Acid value: 22.4 mgKOH/g

Softening point ($T_{1/2}$): 120° C.

Flow ending point ($T_{end}$): 127° C.

Average circularity: 0.922

Preparation Example 2 of Toner Particles

The following components were mixed.

| | |
|---|---|
| C.I. Pigment Blue 15:3 | 50 parts |
| Sodium dodecylsulfate | 10 parts |
| Ion exchange water | 200 parts |

The mixture was subjected to a dispersing treatment using a sand grinder mill to prepare a cyan colorant dispersion in which the cyan colorant has a volume average particle diameter (D50) of 170 nm.

The following components were fed into a 5-litter separable flask equipped with a stirrer, a temperature sensor, a condenser and a nitrogen feed pipe.

| | |
|---|---|
| Sodium dodecylsulfate | 4.05 g |
| Ion exchange water | 2500 g |

The mixture (i.e., dispersion medium) was heated to 80° C. while agitated by the stirrer at a revolution of 230 rpm under a nitrogen gas flow. Then an initiator solution including 9.62 g of a polymerization initiator (i.e., potassium persulfate) dissolved in 200 g of ion exchange water was added thereto.

Then the following monomer mixture was dropped thereto over 90 minutes.

| | |
|---|---|
| Styrene | 612 g |
| n-Butyl acrylate | 156 g |
| Methacrylic acid | 32 g |
| n-Octyl mercaptan | 13 g |

Then the mixture was heated for 2 hours at 80° C. while agitated to perform polymerization (i.e., first-step polymerization). Thus, a latex 1L was prepared. The softening point ($T_{1/2}$) of the solid component of the latex 1L was 124° C.

Next, the following components were fed into a 5-litter separable flask equipped with a stirrer, a temperature sensor, a condenser and a nitrogen feed pipe.

| | |
|---|---|
| Sodium dodecylsulfate | 4.05 g |
| Ion exchange water | 2500 g |

The mixture (i.e., dispersion medium) was heated to 80° C. while agitated by the stirrer at a revolution of 230 rpm under a nitrogen gas flow. Then an initiator solution including 9.62 g of a polymerization initiator (i.e., potassium persulfate) dissolved in 200 g of ion exchange water was added thereto.

Then the following monomer mixture was dropped thereto over 90 minutes.

| | |
|---|---|
| Styrene | 568 g |
| n-Butyl acrylate | 164 g |
| Methacrylic acid | 68 g |
| n-Octyl mercaptan | 16.51 g |

Then the mixture was heated for 2 hours at 80° C. while agitated to perform polymerization (i.e., first-step polymerization). Thus, a latex 1H was prepared. The weight average particle diameter of the latex 1H was 68 nm.

The following components were fed into a flask equipped with a stirrer.

| | |
|---|---|
| Styrene | 123.81 g |
| n-Butyl acrylate | 39.51 g |
| Methacrylic acid | 12.29 g |
| n-Octyl mercaptan | 0.72 g |
| Paraffin wax | 75.0 g |

The mixture was heated to 80° C. to prepare a monomer solution A.

On the other hand, a dispersion including the following components was heated to 98° C.

| | |
|---|---|
| $C_{10}H_{21}(OCH_2CH_2)_2OSO_3Na$ | 0.60 g |
| Ion exchange water | 2700 g |

Then the above-prepared latex 1H which serves as core particles was added thereto such that the weight of the solid component of the latex is 32 g, followed by addition of the above-prepared monomer solution A. The mixture was subjected to a dispersion treatment for 8 hours using a mechanical dispersion machine CLEARMIX from M Technique, which has a circulation path. Thus, an emulsion was prepared. Then a polymerization initiator solution including 6.12 g of potassium persulfate dissolved in 250 ml of ion exchange water was added to the emulsion. The mixture was heated for 12 hours at 82° C. to perform a second step polymerization. Thus, a latex 1HM including complex resin particles in which the surface of the particles of the latex 1H is covered with a polymer.

A polymerization initiator solution which is prepared by dissolving 8.8 g of a polymerization initiator KPS in 350 ml of ion exchange water was added to the latex 1HM. The following monomer mixture was added to the mixture over 1 hour, wherein the mixture was heated at 82° C.

| | |
|---|---|
| Styrene | 350 g |
| n-Butyl acrylate | 95 g |
| Methacrylic acid | 5 g |
| n-Octyl mercaptan | 6.1 g |

Further, the mixture was heated while agitated to perform a third step polymerization.

After the third step polymerization, the reaction product was cooled to 28° C. Thus, a latex 1HML which is a dispersion of complex resin particles in which a core made of the latex 1H is covered with an intermediate layer made of the second step polymer including a release agent, and an outermost layer made of the third step polymer was prepared. The content of the release agent in the latex 1HML is 12.5% by weight based on the monomers used. The softening point ($T_{1/2}$) of the solid component of the latex 1HML was 131° C.

The following components were fed into a four-necked reaction vessel equipped with a temperature sensor, a condenser, a nitrogen feed pipe and a stirrer and agitated to be mixed.

| | |
|---|---|
| Latex 1L | 240 g (weight of solid) |
| Latex 1HML | 180 g (weight of solid) |
| Cyan colorant dispersion | 150 g |
| Ion exchange water | 900 g |

After the temperature of the mixture was controlled to be 30° C., a 5N aqueous solution of sodium hydroxide was added to control the pH of the mixture to be 8 to 10. Then an aqueous solution, which was prepared by dissolving 65 g of magnesium chloride hexahydrate in 1000 ml of ion exchange water, was added thereto over 10 minutes while the mixture was agitated and the temperature thereof was controlled at 30° C. After the mixture was allowed to settle for 3 minutes, the mixture was heated to 92° C., to form agglomerated particles. When the agglomerated particles had a volume average particle diameter of 6.6 μm, an aqueous solution which was prepared by dissolving 80.4 g of sodium chloride in 1000 ml of ion exchange water was added thereto to stop the particle growth of the particles. Further, an aging treatment in which the mixture was heated to 94° C. while agitated was performed to fuse the agglomerated particles and to perform phase separation of the crystalline material. The particle shape factor (i.e., circularity) of the particles was measured using an analyzer FPIA-2000. When the particles had a circularity of 0.952, the mixture was cooled to 30° C. and agitation was stopped. The mixture was filtered to obtain the particles, and the particles were repeatedly washed with ion exchange water of 45° C. Then the particles were dried by air of 40° C. Thus, toner particles 2 was prepared. The toner particles had a volume average particle diameter of 6.5 μm and an average circularity of 0.954. In addition, the toner particles 2 had an acid value of 25.1 mgKOH/g, a softening point ($T_{1/2}$) of 127° C. and a flow ending point ($T_{end}$) of 135° C.

Preparation Example 3 of Toner Particles

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 30 minutes while the stirrer was rotated at a revolution of 3800 rpm. As a result, a milky emulsion was prepared. Then the emulsion was heated to 75° C. to react the monomers for 4 hours.

Further, 30 parts of a 1% aqueous solution of ammonium persulfate were added thereto, and the mixture was aged for 6 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid, hereinafter referred to as particulate resin dispersion (1)) was prepared.

The volume average particle diameter of the particles in the particulate resin dispersion (1), which was measured with an instrument LA-920 from Horiba Ltd., was 110 nm. In addition, part of the particulate resin dispersion (1) was dried to prepare a solid of the vinyl resin. It was confirmed that the vinyl resin has a glass transition temperature (Tg) of 58° C. and a weight average molecular weight of 130,000.

Preparation of Aqueous Phase Liquid

In a reaction vessel equipped with a stirrer, 990 parts of water, 83 parts of the particulate resin dispersion 1 prepared above, 37 parts of an aqueous solution of a sodium salt of dodecyldiphenyletherdisulfonic acid (ELEMINOL MON-7 from Sanyo Chemical Industries Ltd., solid content of 48.3%), and 90 parts of ethyl acetate were mixed while agitated. As a result, a milky liquid (hereinafter referred to as an aqueous phase liquid 1) was prepared.

Preparation of Low Molecular Weight Polyester Resin

The following components were contained in a reaction container equipped with a condenser, a stirrer and a nitrogen feed pipe to perform a polycondensation reaction for 7 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg.

Further, 44 parts of trimellitic anhydride was added to the container to be reacted with the reaction product for 3 hours at 180° C. under normal pressure. Thus, a low molecular weight polyester resin 1 was prepared. The low molecular weight polyester resin 1 had a number average molecular weight of 2300, a weight average molecular weight of 6700, a glass transition temperature (Tg) of 43° C. and an acid value of 25 mgKOH/g.

Synthesis of Intermediate Polyester

The following components were contained in a reaction vessel equipped with a condenser, a stirrer and a nitrogen feed pipe and reacted for 7 hours at 230° C. under normal pressure.

| | |
|---|---|
| Ethylene oxide (2 mole) adduct of bisphenol A | 682 parts |

-continued

| | |
|---|---|
| Propylene oxide (2 mole) adduct of bisphenol A | 81 parts |
| Terephthalic acid | 283 parts |
| Trimellitic anhydride | 22 parts |
| Dibutyl tin oxide | 2 parts |

Then the reaction was further continued for 5 hours under a reduced pressure of from 10 to 15 mmHg. Thus, an intermediate polyester resin 1 was prepared. The intermediate polyester 1 had a number average molecular weight of 2200, a weight average molecular weight of 9700, a glass transition temperature (Tg) of 54° C., an acid value of 0.5 mgKOH/g and a hydroxyl value of 52 mgKOH/g.

In a reaction vessel equipped with a condenser, a stirrer and a nitrogen feed pipe, 410 parts of the intermediate polyester resin 1, 89 parts of isophorone diisocyanate and 500 parts of ethyl acetate were mixed and the mixture was heated for 5 hours at 100° C. to perform the reaction. Thus, a polyester prepolymer 1 having an isocyanate group was prepared. The content of free isocyanate included in the polyester prepolymer 1 was 1.53% by weight.

Synthesis of Ketimine Compound

In a reaction vessel equipped with a stirrer and a thermometer, 170 parts of isophorone diamine and 75 parts of methyl ethyl ketone were mixed and reacted for 4.5 hours at 50° C. to prepare a ketimine compound. The ketimine compound has an amine value of 417 mgKOH/g.

Preparation of Master Batch

The following components were mixed using a HENSCHEL MIXER mixer from Mitsui Mining Co., Ltd.

| | |
|---|---|
| Water | 1200 parts |
| Carbon black (PRINTEX 35 from Degussa A.G. having DBP oil absorption of 42 ml/100 g and pH of 9.5) | 540 parts |
| Polyester resin | 1200 parts |

The mixture was kneaded for 1 hour at 130° C. using a two roll mill. Then the kneaded mixture was cooled by rolling, followed by pulverization using a pulverizer. Thus, a master batch 1 was prepared.

Preparation of Oil Phase Liquid

In a reaction vessel equipped with a stirrer and a thermometer, 378 parts of the low molecular weight polyester resin 1, 100 parts of carnauba wax, and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch 1 and 500 parts of ethyl acetate were added to the vessel, and the mixture was agitated for 1 hour to prepare a raw material dispersion 1.

Then 1324 parts of the raw material dispersion 1 were subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the low molecular weight polyester resin 1 prepared above was added thereto. The mixture was subjected to the dispersion treatment using the bead mill. The dispersion conditions are the same as those mentioned above except that the dispersion operation was performed twice (i.e., two passes).

The thus prepared colorant/wax dispersion (1) had a solid content of 50% when it was determined by heating the liquid at 130° C. for 30 minutes.

Emulsification and Solvent Removal

Then the following components were mixed in a vessel.

| | |
|---|---|
| Colorant/wax dispersion (1) prepared above | 749 parts |
| Prepolymer (1) prepared above | 115 parts |
| Ketimine compound (1) prepared above | 2.9 parts |

The components were agitated for 1 minute with a TK HOMOMIXER from Tokushu Kika Kogyo K.K. at a revolution of 5,000 rpm. Thus, an oil phase liquid (1) (i.e., a toner composition liquid) was prepared.

In a container, 1,200 parts of the above-prepared aqueous phase liquid 1 and 866.9 parts of the oil phase liquid 1 prepared above were mixed and the mixture was mixed for 25 minutes using TK HOMOMIXER at a revolution of 13,000 rpm. Thus, an emulsion 1 was prepared.

The emulsion 1 was fed into a container equipped with a stirrer having paddles and a thermometer, and the emulsion was heated for 8 hours at 30° C. while agitated to remove the organic solvent (ethyl acetate) from the emulsion. Then the emulsion was aged for 7 minutes at 45° C.

Washing and Drying

One hundred (100) parts of the dispersion 1 was filtered under a reduced pressure.

Then the wet cake was mixed with 100 parts of ion-exchange water and the mixture was agitated for 10 minutes with a TK HOMOMIXER at a revolution of 12,000 rpm, followed by filtering. Thus, a wet cake (a) was prepared.

The thus prepared wet cake (a) was mixed with 100 parts of a 10% sodium hydroxide and the mixture was agitated for 30 minutes with TK HOMOMIXER at a revolution of 12,000 rpm, followed by filtering under a reduced pressure. Thus, a wet cake (b) was prepared.

The thus prepared wet cake (b) was mixed with 100 parts of a 10% hydrochloric acid and the mixture was agitated for 10 minutes with TK HOMOMIXER at a revolution of 12,000 rpm, followed by filtering. Thus, a wet cake (c) was prepared.

Then the wet cake (c) was mixed with 300 parts of ion-exchange water and the mixture was agitated for 10 minutes with TK HOMOMIXER at a revolution of 12,000 rpm, followed by filtering. This operation was repeated twice. Thus, a wet cake (1) was prepared.

The wet cake (1) was dried for 48 hours at 45° C. using a circulating air drier, followed by sieving with a screen having openings of 75 μm.

Thus, toner particles 3 were prepared. The toner particles 3 had a softening point ($T_{1/2}$) of 108° C.

EXAMPLES AND COMPARATIVE EXAMPLES

As described in Table 1, 100 parts of one of the toner particles 1-3 was mixed with the particulate inorganic materials A, B and C using a HENSCHEL MIXER mixer. Then the mixtures were sieved using a vibration sieve. Thus, toners of Examples 1-20 and Comparative Examples 1-5 were prepared.

TABLE 1

| | | Inorganic material A | | Inorganic material B | | Inorganic material C | |
|---|---|---|---|---|---|---|---|
| | Toner Particles | No. | Added Amount (part) | No. | Added Amount (part) | No. | Added Amount (part) |
| Ex. 1 | 1 | A-2 | 1.5 | B-1 | 0.8 | C-1 | 1.5 |
| Ex. 2 | 1 | A-2 | 2.5 | B-1 | 0.8 | C-1 | 1.5 |
| Ex. 3 | 1 | A-3 | 1.5 | B-1 | 0.8 | C-1 | 1.5 |
| Ex. 4 | 1 | A-4 | 1.5 | B-1 | 0.8 | C-1 | 1.5 |
| Ex. 5 | 1 | A-2 | 1.5 | B-2 | 0.8 | C-1 | 1.5 |
| Ex. 6 | 1 | A-2 | 1.5 | B-3 | 0.8 | C-1 | 1.5 |
| Ex. 7 | 1 | A-2 | 1.5 | B-1 | 0.8 | C-2 | 1.5 |
| Ex. 8 | 1 | A-2 | 1.5 | B-1 | 0.8 | C-3 | 1.5 |
| Ex. 9 | 2 | A-2 | 1.5 | B-1 | 0.8 | C-1 | 1.5 |
| Ex. 10 | 3 | A-2 | 1.5 | B-1 | 0.8 | C-1 | 1.5 |
| Ex. 11 | 1 | A-1 | 1.5 | B-1 | 0.8 | C-1 | 1.5 |
| Ex. 12 | 1 | A-1 | 2.5 | B-1 | 0.8 | C-1 | 1.5 |
| Ex. 13 | 1 | A-5 | 1.5 | B-1 | 0.8 | C-1 | 1.5 |
| Ex. 14 | 1 | A-6 | 1.5 | B-1 | 0.8 | C-1 | 1.5 |
| Ex. 15 | 1 | A-1 | 1.5 | B-2 | 0.8 | C-1 | 1.5 |
| Ex. 16 | 1 | A-1 | 1.5 | B-3 | 0.8 | C-1 | 1.5 |
| Ex. 17 | 1 | A-1 | 1.5 | B-2 | 0.8 | C-2 | 1.5 |
| Ex. 18 | 1 | A-1 | 1.5 | B-3 | 0.8 | C-3 | 1.5 |
| Ex. 19 | 2 | A-1 | 1.5 | B-1 | 0.8 | C-1 | 1.5 |
| Ex. 20 | 3 | A-1 | 1.5 | B-1 | 0.8 | C-1 | 1.5 |
| Comp. Ex. 1 | 1 | A-7 | 1.5 | B-1 | 0.8 | C-1 | 1.5 |
| Comp. Ex. 2 | 1 | A-6 | 1.5 | B-1 | 0.8 | C-1 | 1.5 |
| Comp. Ex. 3 | 1 | A-1 | 1.5 | — | — | C-1 | 1.5 |
| Comp. Ex. 4 | 1 | A-6 | 1.5 | B-1 | 0.8 | — | — |
| Comp. Ex. 5 | 3 | — | — | B-1 | 0.8 | C-1 | 1.5 |

The details of the particulate inorganic materials A-5, B-1-3 and C-1-3 are shown in Table 2.

TABLE 2

| | |
|---|---|
| A-6 | Commercialized strontium titanate having an average primary particle diameter of 0.1 μm and an average secondary particle diameter of 0.35 μm. |
| A-7 | Commercialized magnesium silicate having an average primary particle diameter of 0.7 μm and an average secondary particle diameter of 3 μm. |
| B-1 | RX200 from Nippon Aerosil Co., which is subjected to a hexamethyldisilazane (HMDS) treatment and which has a hydrophobicity of 80 and an average primary particle diameter of 12 nm. |
| B-2 | TG811F from Cabot Corp., which is subjected to a HMDS treatment and which has a hydrophobicity of 90 and an average primary particle diameter of 8 nm. |
| B-3 | H1303 from Clariant Japan K.K., which is subjected to a HMDS treatment and which has a hydrophobicity of 80 and an average primary particle diameter of 16 nm. |
| C-1 | NX-90 from Nippon Aerosil Co., which is subjected to a HMDS treatment and which has a hydrophobicity of 80 and an average primary particle diameter of 23 nm. |
| C-2 | NAX-50 from Nippon Aerosil Co., which is subjected to a HMDS treatment and which has a hydrophobicity of 80 and an average primary particle diameter of 28 nm. |
| C-3 | Anatase titania having an average primary particle diameter of 50 nm, the surface of which is treated with iso-butyltrimethoxysilane. |

Evaluation Method

Each of the thus prepared toners was evaluated with respect to the following properties.

(1) Development Properties

Each toner was set in a tandem full color printer, IPSIO CX-3000 from Ricoh Co., Ltd., which uses a non-magnetic one component development method and a contact charging method to perform a running test in which 8000 copies of an original image having an image area proportion of 15% are continuously produced. The produced images were visually observed to determine whether the images have background development. In addition, the developing roller was visually observed to determine whether the developing roller has a toner film thereon and a uniform toner layer without a streak is formed on the developing roller.

The development properties are graded as follows.

◎: There is no problem. (Excellent)

○: One of phenomena of background development, filming, streak and uneven toner layer occurs but the toner is still acceptable.

Δ: One of phenomena of background development, filming, streak and uneven toner layer occurs to an extent such that the phenomenon causes a problem when toner is practically used.

X: One of phenomena of serious background development, filming, scratch and uneven toner layer occur. (bad)

(2) Cleanability

After the running test, the surface of the image bearing member (i.e., photoreceptor) was visually observed to determine whether there are residual toner particles on the image bearing member even after a cleaning operation.

The cleanability is graded as follows.

○: No residual toner particles are observed.

X: Residual toner particles are observed.

(3) Photoreceptor Contamination Property

After the running test, the surface of the image bearing member (i.e., photoreceptor) was visually observed to determine whether there is a toner film or a scratch on the image bearing member.

The photoreceptor contamination property is graded as follows.

○: There is no film or scratch on the surface of the image bearing member.

X: There is a film or a scratch on the surface of the image bearing member.

(4) Charging Roller Contamination Property

After the running test, the surface of the charging roller was visually observed to determine whether there is a toner film on the contact charging roller.

The charging roller contamination property is graded as follows.

○: There is no film on the surface of the charging roller and defective charging of the photoreceptor does not occur.

Δ: There is a thin film on the surface of the charging roller but the charging of the photoreceptor is still acceptable.

X: There is a film on the surface of the charging roller and defective charging of the photoreceptor occurs.

(5) Image Omission (i.e., Hollow Image)

After the running test, fine line images were produced. The fine line images were visually observed to determine whether the line images have omissions (i.e., whether the line images are a hollow image).

○: The images have no omission.

Δ: The images have a slight omission but the images are still acceptable.

X: The images have omissions such that the omissions cause a problem when the toner is practically used.

The evaluation results are shown in Table 3.

TABLE 3

| | Development properties | Cleanability | Photoreceptor Contamination property | Charging roller Contamination property | Image omission |
|---|---|---|---|---|---|
| Ex. 1 | ○ | ○ | ○ | ○ | ○ |
| Ex. 2 | ◎ | ○ | ○ | ○ | ○ |
| Ex. 3 | ○ | ○ | ○ | ○ | ○ |
| Ex. 4 | ○ | ○ | ○ | ○ | ○ |
| Ex. 5 | ○ | ○ | ○ | ○ | ○ |
| Ex. 6 | ○ | ○ | ○ | ○ | ○ |
| Ex. 7 | ○ | ○ | ○ | ○ | ○ |
| Ex. 8 | ○ | ○ | ○ | ○ | ○ |
| Ex. 9 | ○ | ○ | ○ | ○ | ○ |
| Ex. 10 | ○ | ○ | ○ | ○ | ○ |
| Ex. 11 | ○ | ○ | ○ | Δ | ○ |
| Ex. 12 | ◎ | ○ | ○ | Δ | ○ |
| Ex. 13 | ○ | ○ | ○ | Δ | ○ |
| Ex. 14 | ○ | ○ | ○ | Δ | ○ |
| Ex. 15 | ○ | ○ | ○ | Δ | ○ |
| Ex. 16 | ○ | ○ | ○ | Δ | ○ |
| Ex. 17 | ○ | ○ | ○ | Δ | ○ |
| Ex. 18 | ○ | ○ | ○ | Δ | ○ |
| Ex. 19 | ○ | ○ | ○ | Δ | ○ |
| Ex. | ○ | ○ | ○ | Δ | ○ |

TABLE 3-continued

| | Development properties | Cleanability | Photoreceptor Contamination property | Charging roller Contamination property | Image omission |
|---|---|---|---|---|---|
| Comp. Ex. 1 | X (background development) | ○ | X (scratch) | ○ | ○ |
| Comp. Ex. 2 | X | X | X | ○ | Δ |
| Comp. Ex. 3 | X (uneven toner layer) | ○ | ○ | ○ | ○ |
| Comp. Ex. 4 | ○ | ○ | ○ | ○ | X |
| Comp. Ex. 5 | X (background development) | X | ○ | ○ | ○ |

It is clear from Table 3 that the toner of the present invention has good charging properties and does not cause the problems such as background development, filming, scratching and uneven toner layer problems. Particularly, the toner hardly contaminates contact chargers and thereby high quality images can be produced over a long period of time. Therefore, the toner of the present invention can be preferably used for contact charging methods.

The comparative toner (Comparative Example 1) including a commercialized magnesium silicate causes the background development and scratches the photoreceptor because the magnesium silicate has a relatively large average particle diameter (3 μm).

Next, Examples using a magnesium silicate compound treated with a fatty acid (i.e., the second example embodiment of the toner of the present invention will be explained.

Example 21

Preparation of Magnesium Silicate Compound

The procedure for preparation of the particulate inorganic material A-1 (forsterite) was repeated.

Preparation of External Additive

At first, 100 g of the above-prepared particulate inorganic material A-1 was dispersed in 1 litter of pure water and sodium hydroxide was added such that the mixture has a pH of 10. Then 1.0 g of sodium stearate was added thereto while heating the slurry. Further, hydrochloric acid was added thereto such that the mixture has a pH of 2 and stearic acid is precipitated on the surface of the particulate inorganic material A-1 (i.e., forsterite). After filtration, the particulate inorganic material was washed, followed by drying. Further, the thus prepared particulate inorganic material was dissociated using a jet mill, followed by sieving using a screen having openings of 105 nm. Thus, an external additive D1 which is forsterite having a surface treated with stearic acid in an amount of 1% by weight based on the weight of the external additive.

The procedure for preparation of the external additive D1 was repeated except that the inorganic material, the surface treatment agent and the added amount of the surface treatment agent were changed as described in Table 4. Thus, external additives D2-D4 and D6-D9 were prepared. In this regard, the surface of the external additive 6 is hardly treated with a surface treatment agent (i.e., a silane coupling agent) because the silane coupling agent has poor surface activity. Further, the external additive D5 is forsterite whose surface is not treated.

Preparation of Binder Resin H1W

The following components were contained in a dropping funnel.

| Vinyl monomers | |
|---|---|
| Styrene | 600 g |
| Butyl acrylate | 110 g |
| Acrylic acid | 30 g |
| Dicumylperoxide (polymerization initiator) | 30 g |

The following components were contained in a four-necked 5-liter flask equipped with a thermometer, a stainless stirrer, a condenser, and a nitrogen feed pipe.

| Monomers for polyester resin | |
|---|---|
| Polyoxypropylene(2,2)-2,2-bis(4-hydroxylphenyl)propane | 1230 g |
| Polyoxyethylene(2,2)-2,2-bis(4-hydroxylphenyl)propane | 290 g |
| Isododecenylsuccinic anhydride | 250 g |
| Terephthalic acid | 310 g |
| 1,2,4-benzenetricarboxylic acid anhydride | 180 g |
| Dibutyl tin oxide (esterification catalyst) | 7 g |
| Paraffin wax (melting point: 73.3° C., half width of endothermic peak in DSC: 4° C.) | 340 g |

The components in the four-necked flask were heated to 160° C. by a mantle heater while agitated with the stirrer. In addition, the components in the dropping funnel was dropped in the flask over one hour. After the mixture was heated for 2 hours at 160° C. to complete an addition polymerization reaction, the reaction product was heated to 230° C. to perform a polycondensation reaction. The polymerization degree of the reaction product was occasionally checked using a constant-pressure orifice rheometer. When the reaction product had a desired softening point, the polycondensation reaction was ended. Thus, a resin H1W having a softening point ($T_{1/2}$) of 130° C. was prepared.

Preparation of Toner Particles

The following components were mixed with a HENSCHEL MIXER mixer.

| | |
|---|---|
| First binder resin H1W | 70 parts |
| Second binder resin L1 (prepared above) | 30 parts |
| C.I. Pigment Red 57-1 (included in a master batch) | 4 parts |

The mixture was then melted and kneaded with a double-axis kneader PCM-30 from Ikegai Corp., from which a discharging portion of the kneader is detached. The kneaded mixture was then cooled by a press roller so as to have a thickness of 2 mm, followed by cooling with a cooling belt. The cooled mixture was crushed with a feather mill, followed by pulverization with a mechanical pulverizer, KTM from Kawasaki Heavy Industries Ltd., to prepare particles with an average particle diameter of from 10 to 12 μm. Further, the pulverized mixture was pulverized with a jet pulverizer IDS from Nippon Pneumatic Mfg. Co., Ltd. while coarse particles were removed. Furthermore, the pulverized mixture was subjected to a fine particle classification using a rotor classifier TURBOPLEX 100 ATP from Hosokawa Micron Corp. Thus, toner particles 4 having an average particle diameter of 7.8 μm was prepared.

One hundred (100) parts by weight of the thus prepared toner particles 4 were mixed with 1 part by weight of the above-prepared external additive D1 and 1 part by weight of a silica RX200. In this case, mixing was performed for 60 seconds using a HENSCHEL MIXER mixer in which the tip of the blade is rotated at a peripheral speed of 40 m/sec. Thus, a magenta toner M1 was prepared.

The evaluation results are shown in Table 4.

Examples 22-27 and Comparative Examples 6-11

The procedure for preparation of the magenta toner M1 was repeated except that the external additives were changed as described in Table 4.

Thus, magenta toners of Examples 22-27 (magenta toners M2-M7) and Comparative Examples 6-11 (magenta toners M8-M11).

The formulation of the magenta toners and results of evaluation of the toners are shown in Table 5 and 6.

TABLE 4

| External additive No. | Particulate inorganic material | Surface treatment agent | Added amount of surface treatment agent (% by weight) |
|---|---|---|---|
| D1 | Forsterite | Stearic acid | 1 |
| D2 | Forsterite | Stearic acid | 4 |
| D3 | Forsterite | Stearic acid | 8 |
| D4 | Forsterite | Lauric acid | 4 |
| D5 | Forsterite | Arachic acid | 4 |
| D6 | Forsterite | None | 0 |
| D7 | Forsterite | Silane coupling agent | 4 |
| D8 | Forsterite | Calcium stearate | 4 |
| D9 | Forsterite | Amino compound | 4 |
| D10 | Titania | Stearic acid | 4 |

TABLE 5

| | | External additive | | | |
|---|---|---|---|---|---|
| | | Magnesium silicate compound | | Silica | |
| | Magenta toner No. | Name (External additive No.) | Added amount (% by weight) | Name | Added amount (% by weight) |
| Ex. 21 | M1 | D1 | 1.0 | Silica RX200 | 1.0 |
| Ex. 22 | M2 | D2 | 0.05 | Silica RX200 | 1.0 |
| Ex. 23 | M3 | D2 | 1.0 | Silica RX200 | 1.0 |
| Ex. 24 | M4 | D2 | 5.0 | Silica RX200 | 1.0 |
| Ex. 25 | M5 | D3 | 1.0 | Silica RX200 | 1.0 |
| Ex. 26 | M6 | D4 | 1.0 | Silica RX200 | 1.0 |
| Ex. 27 | M7 | D5 | 1.0 | Silica RX200 | 1.0 |
| Comp. Ex. 6 | M8 | D6 | 1.0 | Silica RX200 | 1.0 |
| Comp. Ex. 7 | M9 | D7 | 1.0 | Silica RX200 | 1.0 |
| Comp. Ex. 8 | M10 | D8 | 1.0 | Silica RX200 | 1.0 |
| Comp. Ex. 9 | M11 | D9 | 1.0 | Silica RX200 | 1.0 |
| Comp. Ex. 10 | M12 | None | 0 | Silica RX200 | 1.0 |
| Comp. Ex. 11 | M13 | D10 | 1.0 | Silica RX200 | 1.0 |

TABLE 6

| | Evaluation results | | | | | |
|---|---|---|---|---|---|---|
| | Toner leakage | Streak on DR | Back-Ground development | Image density | Contamination of charger | Filming on photoreceptor |
| Ex. 21 | Good | Good | Good | Good | Acceptable | Good |
| Ex. 22 | Acceptable | Acceptable | Good | Good | Good | Good |
| Ex. 23 | Good | Good | Good | Good | Good | Good |
| Ex. 24 | Good | Good | Acceptable | Good | Acceptable | Acceptable |
| Ex. 25 | Good | Acceptable | Good | Good | Good | Acceptable |
| Ex. 26 | Good | Good | Acceptable | Good | Good | Good |
| Ex. 27 | Good | Good | Good | Good | Acceptable | Acceptable |

TABLE 6-continued

| | Evaluation results | | | | | |
|---|---|---|---|---|---|---|
| | Toner leakage | Streak on DR | Back-Ground development | Image density | Contamination of charger | Filming on photoreceptor |
| Comp. Ex. 6 | Good | Good | Good | Good | Bad | Good |
| Comp. Ex. 7 | Good | Good | Good | Good | Bad | Good |
| Comp. Ex. 8 | Acceptable | Good | Bad | Good | Bad | Good |
| Comp. Ex. 9 | Acceptable | Good | Bad | Good | Bad | Good |
| Comp. Ex. 10 | Bad | Bad | Acceptable | Bad | Good | Good |
| Comp. Ex. 11 | Acceptable | Acceptable | Bad | Good | Good | Good |

It is clear from Table 6 that the second example embodiment of the toner of the present invention can produce good images without causing problems such as background development, toner leakage, toner leakage, streak of toner layer, contamination of charger and filming on photoreceptor. Therefore the toner can be preferably used for image forming apparatuses such as electrophotographic copiers and printers.

This document claims priority and contains subject matter related to Japanese Patent Applications Nos. 2006-036086, 2006-060883 and 2006-075640, filed on Feb. 14, 2006, Mar. 7, 2006 and Mar. 17, 2006, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin;

a colorant; and a release agent, and an external additive comprising a first particulate inorganic material having a formula of $M_xSi_yO_{x+2y}$ wherein each of x and y is an integer, and a number average secondary particle diameter of the first particulate inorganic material is from 0.02 μm to 2 μm, a first atomic ratio (Mg/Si)s in a surface portion of the first particulate inorganic material is less than a second atomic ratio (Mg/Si)e in the entire first particulate inorganic material.

2. The toner according to claim 1, wherein the first particulate inorganic material has a number average primary particle diameter of from 0.02 μm to 0.15 μm.

3. The toner according to claim 1, wherein the first particulate inorganic material includes sintered aggregates of $Mg_xSi_yO_{x-2y}$ having a number average secondary particle diameter of from 0.05 μm to 2 μm.

4. The toner according to claim 1, wherein the first particulate inorganic material includes at least one member selected from the group consisting of forsterite, enstatite and steatite.

5. The toner according to claim 4, wherein the external additive further comprises:

a second particulate inorganic material including a particulate hydrophobic silica having a number average primary particle diameter of from 5 nm to 20 nm; and a third particulate inorganic material including a member selected from the group consisting of particulate hydrophobic titania, particulate hydrophobic silica, and a combination thereof, all of which have a number average primary particle diameter of from 20 nm to 100 nm.

6. The toner according to claim 5, wherein an amount of the first particulate inorganic material is from 0.3% to 5% by weight based on a weight of the toner particles, and a total amount of the second and third particulate inorganic materials is from 2% to 5% by weight based on the weight of the toner particles.

7. The toner according to claim 5, wherein a weight ratio (B/C) of the second particulate inorganic material (B) to the third particulate inorganic material (C) is from 1/9 to 7/3.

8. The toner according to claim 1, wherein the first inorganic material is prepared by a method comprising:

sintering a $Mg(OH)_2$ powder or a MgO powder together with a $SiO_2$ powder having a number average primary particle diameter of not greater than 0.10 μm; and subjecting the sintered material to a surface treatment to control the second atomic ratio (Mg/Si)s in a surface portion of the particulate inorganic material.

9. The toner according to claim 1, wherein the external additive further comprises:

a second particulate inorganic material including a particulate hydrophobic silica having a number average primary particle diameter of from 5 nm to 20 nm; and a third particulate inorganic material including a member selected from the group consisting of particulate hydrophobic titania, particulate hydrophobic silica, and a combination thereof, all of which have a number average primary particle diameter of from 20 nm to 100 nm.

10. The toner according to claim 9, wherein the first particulate inorganic material has a number average primary particle diameter of from 0.01 μm to 0.5 μm.

11. The toner according to claim 9, wherein each of the second particulate inorganic material and the third particulate inorganic material has a hydrophobicity of from 50 to 90.

12. The toner according to claim 1, wherein the toner particles have a volume average particle diameter of from 4 μm to 9 μm.

13. The toner according to claim 1, wherein a content of the release agent is from 3.5 to 10% by weight based on a total weight of the toner particles when the toner particles are prepared by a pulverization method.

14. The toner according to claim 1, wherein a content of the release agent is from 5 to 12% by weight based on a total weight of the toner particles when the toner particles are prepared by a wet granulation method.

15. A toner comprising:

toner particles comprising:

a binder resin;

a colorant, and an external additive which comprises a particulate inorganic material having a formula of $Mg_xSi_yO_{x+2y}$ wherein each of x and y is an integer, a first atomic ratio (Mg/Si)s in a surface portion of the first particulate inorganic material is less than a second atomic ratio (Mg/Si)e in the entire first particulate inorganic material, and a surface of the particulate inorganic material is treated with a fatty acid.

16. The toner according to claim 15, wherein the fatty acid is of formula $C_nH_{2n+1}COOH$ wherein n is an integer of from 10 to 25.

17. The toner according to claim 15, wherein an average primary particle diameter of the particulate inorganic material is from 0.05 to 0.15 μm and an average secondary particle diameter of the particulate inorganic material is from 0.2 to 0.6 μm, and an amount of the particulate inorganic material is from 0.05 to 2 parts by weight based on 100 parts by weight of the toner particles.

18. The toner according to claim 15, wherein the particulate inorganic material includes at least one member selected from the group consisting of forsterite, enstatite and steatite.

19. An image forming method comprising:

forming an electrostatic latent image on an image bearing member; and developing the electrostatic latent image with a developer including the toner according to claim 1 to form a toner image on the image bearing member.

20. An image forming method comprising:

forming an electrostatic latent image on an image bearing member; and developing the electrostatic latent image with a developer including the toner according to claim 15 to form a toner image on the image bearing member.

* * * * *